US007823876B2

(12) United States Patent
Okumura et al.

(10) Patent No.: US 7,823,876 B2
(45) Date of Patent: Nov. 2, 2010

(54) SHEET FEEDING DEVICE AND IMAGE FORMING APPARATUS INCLUDING SHEET FEEDING DEVICE WITH REAR END DETECTION PORTION

(75) Inventors: Keiji Okumura, Osaka (JP); Yoshio Sugishima, Osaka (JP); Masahiko Miyazaki, Osaka (JP); Seiichi Shirasaki, Osaka (JP); Yasunori Ueno, Osaka (JP); Sachio Izumichi, Osaka (JP)

(73) Assignee: Kyocera Mita Corporation (JP)

( * ) Notice: Subject to any disclaimer, the term of this patent is extended or adjusted under 35 U.S.C. 154(b) by 0 days.

(21) Appl. No.: 12/535,078

(22) Filed: Aug. 4, 2009

(65) Prior Publication Data

US 2010/0025919 A1 Feb. 4, 2010

(30) Foreign Application Priority Data

Aug. 4, 2008 (JP) ..... 2008-200815
Aug. 4, 2008 (JP) ..... 2008-200823

(51) Int. Cl.
*B65H 1/16* (2006.01)

(52) U.S. Cl. ..... 271/155; 271/97; 271/127; 271/30.1; 271/265.01

(58) Field of Classification Search ..... 271/31, 271/128, 265.01, 152
See application file for complete search history.

(56) References Cited

U.S. PATENT DOCUMENTS 4,925,177 A * 5/1990 Nakamura et al. ..... 271/127
7,451,973 B2 11/2008 Koga et al.
2007/0080491 A1 * 4/2007 Suga et al. ..... 271/97

FOREIGN PATENT DOCUMENTS

| | | |
|---|---|---|
| JP | 7-12359 | 3/1995 |
| JP | 2001-48366 | 2/2001 |
| JP | 2003-150024 | 5/2003 |
| JP | 2006-264917 | 10/2006 |

* cited by examiner

*Primary Examiner*—Gene Crawford
*Assistant Examiner*—Gerald W McClain
(74) *Attorney, Agent, or Firm*—Gerald E. Hespos; Michael J. Porco

(57) ABSTRACT

A sheet feeding device includes a sheet accommodating portion for accommodating a sheet stack. A sheet carrying plate carries the sheet stack and has an upstream end supported in the sheet accommodating portion for rotation. A pickup roller contacts an upper face of the sheet stack and dispatches an uppermost sheet. An elevator displaces the sheet carrying plate between a feeding position where the upper face of the sheet stack contacts the pickup roller and a separating position where the upper face of the sheet stack is separated from the pickup roller. A first warm air mechanism blows warm air toward a side of the sheet stack in the sheet accommodating portion, the side being parallel to the sheet feeding direction. A controller controls the elevator so that the sheet carrying plate is displaced between the feeding position and the separating position during a warm air blowing operation.

15 Claims, 24 Drawing Sheets

SHEET FEEDING DEVICE AND IMAGE FORMING APPARATUS INCLUDING SHEET FEEDING DEVICE WITH REAR END DETECTION PORTION

BACKGROUND OF THE INVENTION

1. Field of the Invention

The present invention relates to a sheet feeding device having a sheet loosening mechanism that employs warm air assistance, and an image forming apparatus including the sheet feeding device.

2. Description of the Related Art

In a conventional image forming apparatus such as a printer, a copier, or a facsimile, cut sheets of high quality paper, regular paper specified by a copier manufacturer, and so on are typically used as a sheet fed continuously into an image formation portion. A cut sheet of high quality paper, regular paper, and so on has low surface smoothness, and therefore a sheet sticking force thereof is comparatively low. It is therefore comparatively easy to prevent multi-feeding, in which a plurality of cut sheets are supplied while stuck together, when dispatching the cut sheets one at a time from a sheet carrying unit such as a sheet feeding tray. Furthermore, even when multi-feeding occurs during use of the cut sheets, the cut sheets can be dispatched one at a time comparatively favorably by providing a separating roller, a separating pad, a separating pawl, or similar.

In recent years, however, diversification of sheet has progressed to the point where not only sheets of high quality paper, regular paper, and so on having low surface smoothness are used. In particular, as colorization techniques become more advanced in image forming apparatuses, the use of recording media having high surface smoothness, such as enhanced-whiteness gloss enamel paper (composite paper coated on one or both sides with a coating color, which is a type of paint, with the aim of improving printing suitability), is becoming more widespread. In other words, not only high quality paper and regular paper, but also the enamel paper described above as well as film sheets, tracing paper, and so on are used in the same machine type. Enamel paper, film sheets, tracing paper, and so on exhibit a strong inter-sheet sticking force, and it is therefore difficult to prevent multi-feeding of the sheets. Hence, special measures must be taken in relation to sheet feeding (sheet dispatch).

Furthermore, an upper face and a peripheral part of a stack of sheets disposed on the sheet carrying unit are exposed to outside air, and are therefore likely to contain a large amount of moisture. In other words, the upper face and side faces of the sheet stack swell due to moisture absorption, whereas the degree of swelling on the inside of the sheet stack is lower than that of the upper face and side faces due to the smaller amount of moisture. As a result, pressure inside (in the inter-sheet spaces of) the sheet stack may turn negative such that the sheets stick together.

To loosen the sheet stack by separating sheets that are stuck together prior to sheet feeding, large copiers and so on employ a sheet feeding device having a mechanism (to be referred to hereafter as "lateral warm air assistance") for blowing warm air onto the side face of the sheet stack. For example, Japanese Patent Application Laid-open No. 2001-48366 discloses a technique for improving sheet drying efficiency in a sheet loosening method employing lateral warm air assistance by appropriately adjusting the humidity of lateral warm air that is blown onto the side face of a sheet stack.

However, in the conventional sheet loosening technique employing lateral warm air assistance described above, it is difficult for the warm air to reach regions remote from a warm air blowing port, and it is therefore difficult to loosen the sheets by introducing warm air into the vicinity of the outer periphery of the sheets, in which the sticking force is particularly strong. In other words, when lateral warm air assistance is used conventionally, required warm air blowing means, heating means, a power supply, and so on must all be large to obtain a favorable loosening effect. Therefore, conventional sheet loosening techniques employing lateral warm air assistance are limited to application to comparatively large sheet feeding decks accommodating between approximately 2000 and 4000 sheets.

SUMMARY OF THE INVENTION

An object of the present invention is to provide a sheet feeding device that can be disposed in a small space and includes a sheet loosening mechanism employing warm air assistance, and an image forming apparatus having the sheet feeding device.

A sheet feeding device according to one aspect of the present invention for achieving this object is a sheet feeding device for feeding a sheet, including a sheet accommodating portion for accommodating a sheet stack constituted by a plurality of sheets of the sheet, a sheet carrying plate for carrying the sheet, a sheet feeding direction upstream side end of which is supported within the sheet accommodating portion to be free to rotate, a pickup roller that contacts an upper face of the sheet stack and dispatches an uppermost sheet of the sheet stack, an elevator mechanism that displaces the sheet carrying plate between a sheet feeding position in which the upper face of the sheet stack contacts the pickup roller and a separating position in which the upper face of the sheet stack is separated from the pickup roller, a first warm air mechanism for blowing warm air toward a side face of the sheet stack accommodated in the sheet accommodating portion, the side face being parallel to the sheet feeding direction, and a controller for controlling the operation of the elevator mechanism, wherein the controller controls the operation of the elevator mechanism such that the sheet carrying plate is displaced between the sheet feeding position and the separating position during a warm air blowing operation performed by the first warm air mechanism.

Further, an image forming apparatus according to another aspect of the present invention includes a sheet feeding device for feeding a sheet, and an apparatus main body including an image formation portion for forming an image on the sheet fed from the sheet feeding device, wherein the sheet feeding device is constituted as described above.

DETAILED DESCRIPTION OF THE PREFERRED EMBODIMENTS

Several embodiments of the present invention will be described in detail below on the basis of the drawings. It is assumed that in each of the drawings, members and so on having identical reference symbols are constituted identically, and therefore duplicate description of these members and so on has been omitted where appropriate. Furthermore, members and so on that do not need to be described have been omitted from the drawings where appropriate.

First Embodiment

Figure 1:
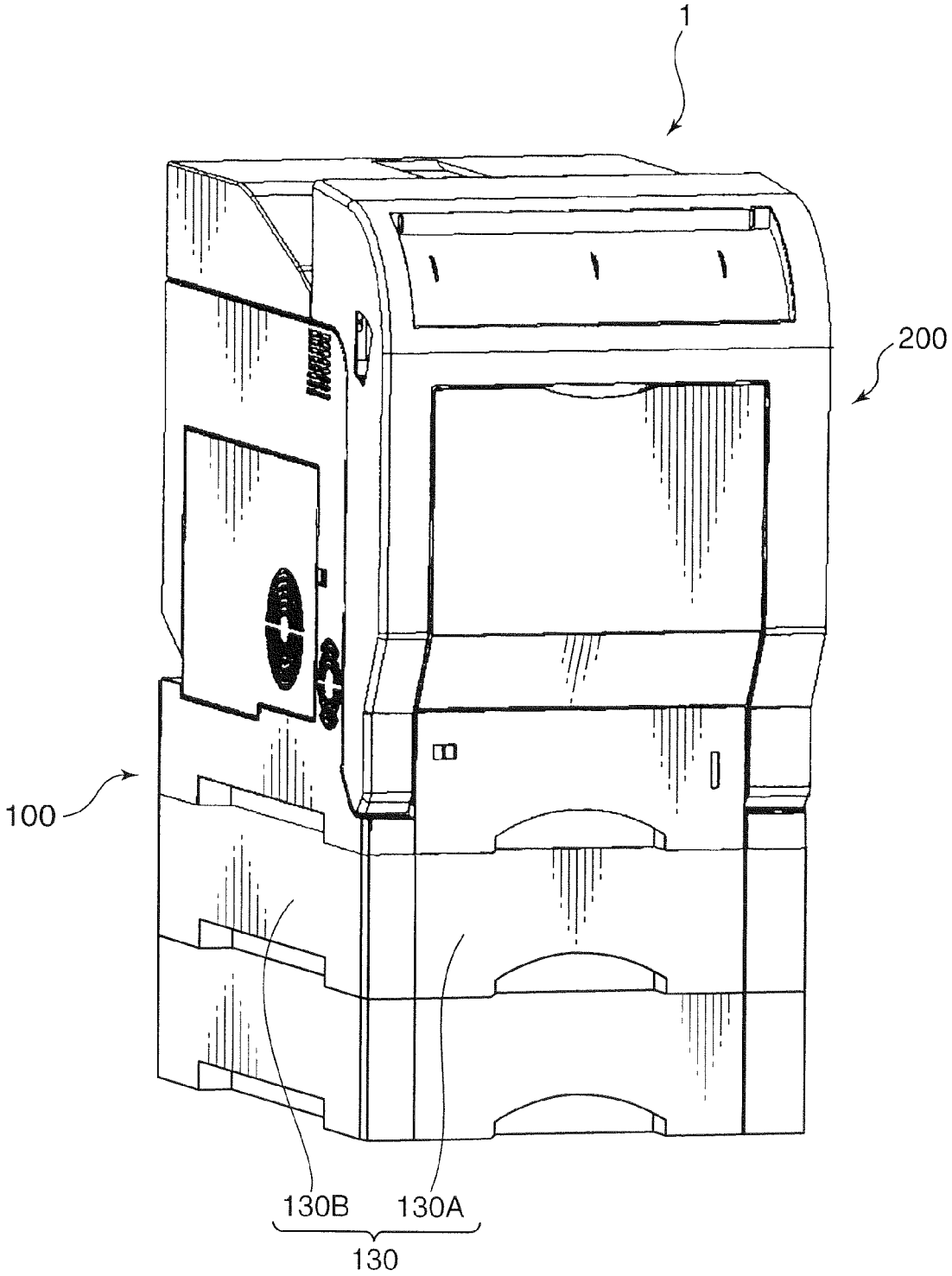
FIG. 1 is a perspective view showing the outer form of a printer including a sheet feeding device according to an embodiment of the present invention.

First, referring to FIG. 1 and FIG. 2, an image forming apparatus including a sheet feeding device according to an embodiment of the present invention will be described. FIG. 1 is a perspective view showing the outer form of an image forming apparatus (a color printer 1) including a sheet feeding device (a sheet feeding unit 130) according to a first embodiment, and FIG. 2 is a sectional view showing the internal structure of the image forming apparatus.

As shown in FIG. 1, the color printer 1 includes a printer main body 200 connected to a personal computer (PC) (not shown) or the like directly or via a LAN, and a sheet supply unit 100 provided beneath the printer main body 200 and constituted to be capable of storing sheets P of various sizes in accordance with their size. Note that the color printer 1 also includes other constitutional elements typically provided in a color printer, such as a control circuit for controlling operations of the color printer 1.

Figure 2:
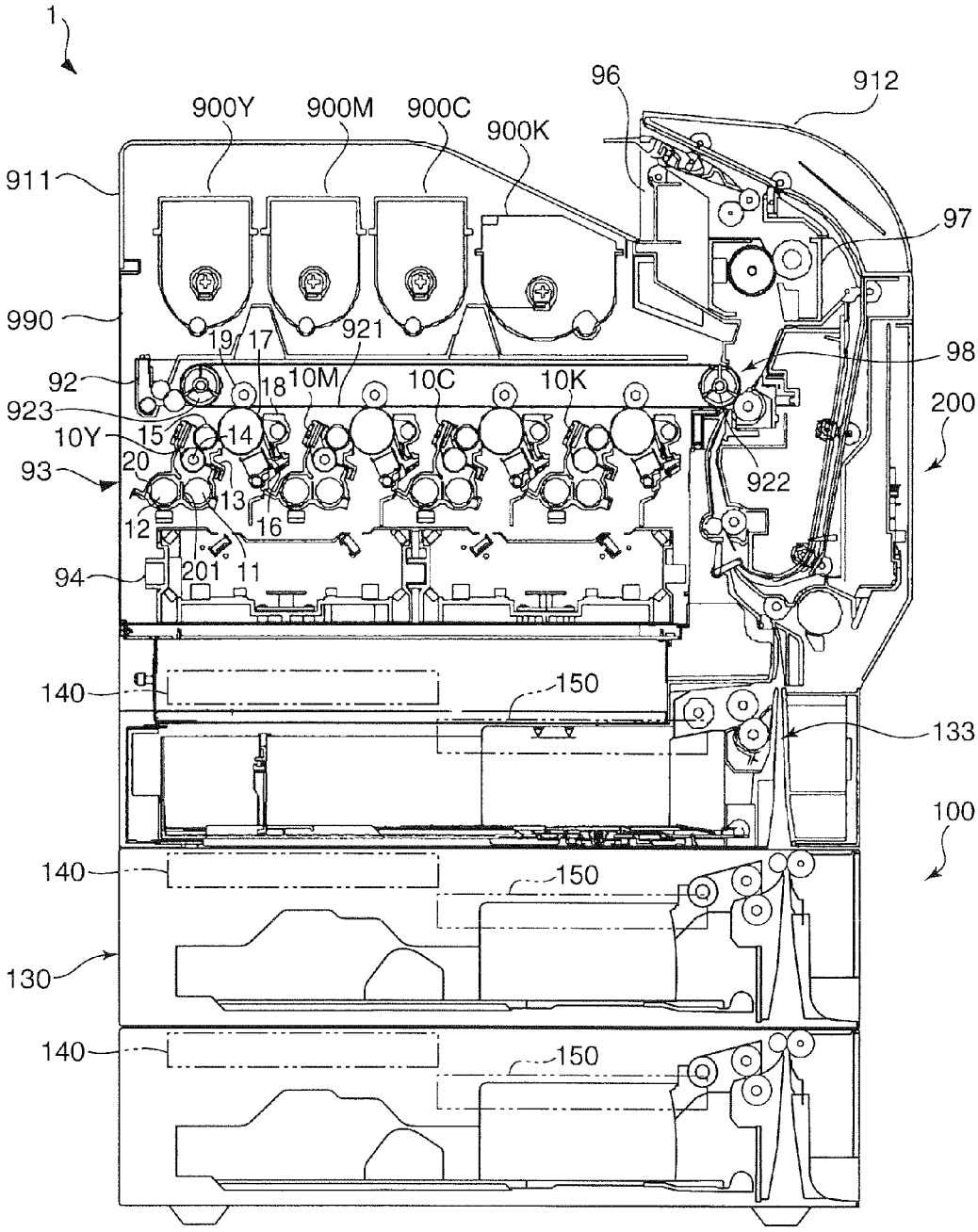
FIG. 2 is a sectional view showing the internal constitution of the printer shown in FIG. 1.

As shown in FIG. 2, the printer main body 200 includes toner containers 900Y, 900M, 900C, 900K, an intermediate transfer unit 92, an image formation unit 93, an exposure unit 94, the sheet supply unit 100, a fixing unit 97, a sheet discharge unit 96, an apparatus main body casing 990, a top cover 911, and a front cover 912.

The image formation unit 93 includes a yellow toner container 900Y, a magenta toner container 900M, a cyan toner container 900C, a black toner container 900K, and developing devices 10Y, 10M, 10C, 10K disposed therebelow in accordance with the respective colors YMCK.

Further, photosensitive drums 17 (photosensitive bodies on which latent images are formed by an electrophotographic method) for carrying toner images in the respective colors are provided in the image formation unit 93. A photosensitive drum using an amorphous silicon (a-Si)-based material may be employed as the photosensitive drum 17. Yellow, magenta, cyan, and black toner is supplied to the respective photosensitive drums 17 from the corresponding toner container 900Y, 900M, 900C, 900K. The image formation unit 93 described above is capable of forming a full color image, but the image formation unit is not limited thereto, and may be constituted to form monochrome images or color images that are not full color.

A charger 16, the developing devices 10 (10Y, 10M, 10C, 10K), a transfer device (transfer roller) 19, a cleaning device 18, and so on are disposed around the photosensitive drum 17. The charger 16 charges the surface of the photosensitive drum 17 uniformly. After being charged, the surface of the photosensitive drum 17 is exposed by the exposure unit 94 such that an electrostatic latent image is formed thereon. The developing devices 10Y, 10M, 10C, 10K use the colored toner supplied by the respective toner containers 900Y, 900M, 900C, 900K to develop (make visible) the electrostatic latent images formed on the respective photosensitive drums 17. The transfer roller 19 forms a nip portion by pressing the intermediate transfer belt 921 against the photosensitive drum 17 and thereby subjects the toner image formed on the photosensitive drum 17 to primary transfer onto the intermediate transfer belt 921. The cleaning device 18 cleans the peripheral surface of the photosensitive drum 17 following toner image transfer.

Each developing devices 10Y, 10M, 10C, 10K includes the casing 20, and a two-component developer constituted by a magnetic carrier and a toner is stored in the interior of the casing 20. Further, two agitating rollers 11, 12 (developer agitating members) are disposed rotatably in the vicinity of a bottom portion of the casing 20 in parallel, taking a lengthwise direction as their axial direction.

A developer circulation route is set on the interior bottom surface of the casing 20, and the agitating rollers 11, 12 are disposed on the circulation route. A partition wall 201 standing upright from the casing bottom portion is provided in the axial direction between the agitating rollers 11, 12. The partition wall 201 defines the circulation route, and the circulation route is formed to travel around the periphery of the partition wall 201. The two-component developer is charged while being agitated by the agitating rollers 11 and 12 so as to travel along the circulation route.

The two-component developer circulates through the casing 20 while being agitated by the agitating rollers 11 and 12, whereby the toner is charged and the two-component developer on the agitating roller 11 is aspirated onto and conveyed by a magnetic roller 14 positioned on an upper side thereof.

The aspirated two-component developer forms a magnetic brush (not shown) on the magnetic roller 14. A layer thickness of the magnetic brush is limited by a doctor blade 13. A toner layer is formed on a developing roller 15 by a potential difference between the magnetic roller 14 and the developing roller 15, and the electrostatic latent image on the photosensitive drum 17 is developed by the toner layer.

The exposure unit 94 includes various optical devices such as a light source, a polygon mirror, a reflection mirror, and a deflection mirror, and irradiates the peripheral surface of the photosensitive drum 17 provided in each of the image formation units 93 with light based on image data to form the electrostatic latent image.

The intermediate transfer unit 92 includes the intermediate transfer belt 921, a drive roller 922, and a driven roller 923. The intermediate transfer belt 921 performs a primary transfer on superimposed toner images applied thereto from the plurality of photosensitive drums 17, and then subjects the toner image to a secondary transfer onto a sheet P supplied by the sheet feeding unit 130 at a secondary transfer portion 98. The drive roller 922 and driven roller 923 drive the intermediate transfer belt 921 to revolve. The drive roller 922 and driven roller 923 are supported by a casing, not shown in the drawings, to be free to rotate.

The fixing unit 97 implements fixing processing on the toner image subjected to the secondary transfer onto the sheet P from the intermediate transfer unit 92. Following completion of the fixing processing, the sheet P with a color image is discharged toward the discharge unit 96 formed on an upper portion of the apparatus main body 200.

The sheet discharge unit 96 discharges the sheet P conveyed thereto from the fixing unit 97 onto the top cover 911, which serves as a sheet discharge tray.

The sheet supply unit 100 includes a plurality of (three in this embodiment) sheet feeding units 130 (sheet feeding devices) attached detachably to the printer main body 200 in tiers. Each sheet feeding unit 130 accommodates a sheet stack S constituted by a plurality of sheets P to be subjected to image formation, and is attached detachably to the casing 990. Sheet stacks S in each of the aforementioned sizes are stored in the respective sheet feeding units 130. In a selected sheet feeding unit 130 during an image formation operation, sheets P on the uppermost layer of the sheet stack S are extracted one at a time by driving a pickup roller 40 provided in the sheet feeding unit 130, dispatched onto a sheet feeding conveyance path 133, and introduced into the image formation unit 93.

Each sheet feeding unit 130 includes a conveyance mechanism, a plurality of which can be attached to a lower portion of the printer main body 200 subsequently in a stacked plurality, and thus, a desired number of the sheet feeding units 130 can be attached subsequently to the printer main body 200 at any time. In other words, by stacking a plurality of the sheet feeding units 130 in the lower portion of the printer main body 200, the conveyance mechanisms provided in the respective sheet feeding units 130 are coupled to each other to form the single sheet feeding conveyance path 133 extending to the printer main body 200. Hence, the sheet feeding units 130 can be attached subsequently in a plurality of stacked tiers.

Note that in this embodiment, an example in which the sheet supply unit 100 is constituted by three sheet feeding units 130 is described, but the present invention is not limited thereto, and may be applied similarly to an image forming apparatus such as a printer having one, two, four, or more sheet feeding units 130.

Next, with reference to FIG. 1 and FIGS. 3 to 5, the constitution of each sheet feeding unit 130 attached to the sheet supply unit 100 of the color printer 1 according to the first embodiment will be described in detail. As shown in FIG. 1, the sheet feeding unit 130 is constituted by a sheet feeding cassette 130A and a sheet feeding unit main body 130B. The sheet feeding cassette 130A slides forward and backward relative to the sheet feeding unit main body 130B. A typical sliding mechanism (a drawer mechanism) may be employed in the sheet feeding cassette 130A and the sheet feeding unit main body 130B.

Figure 3:
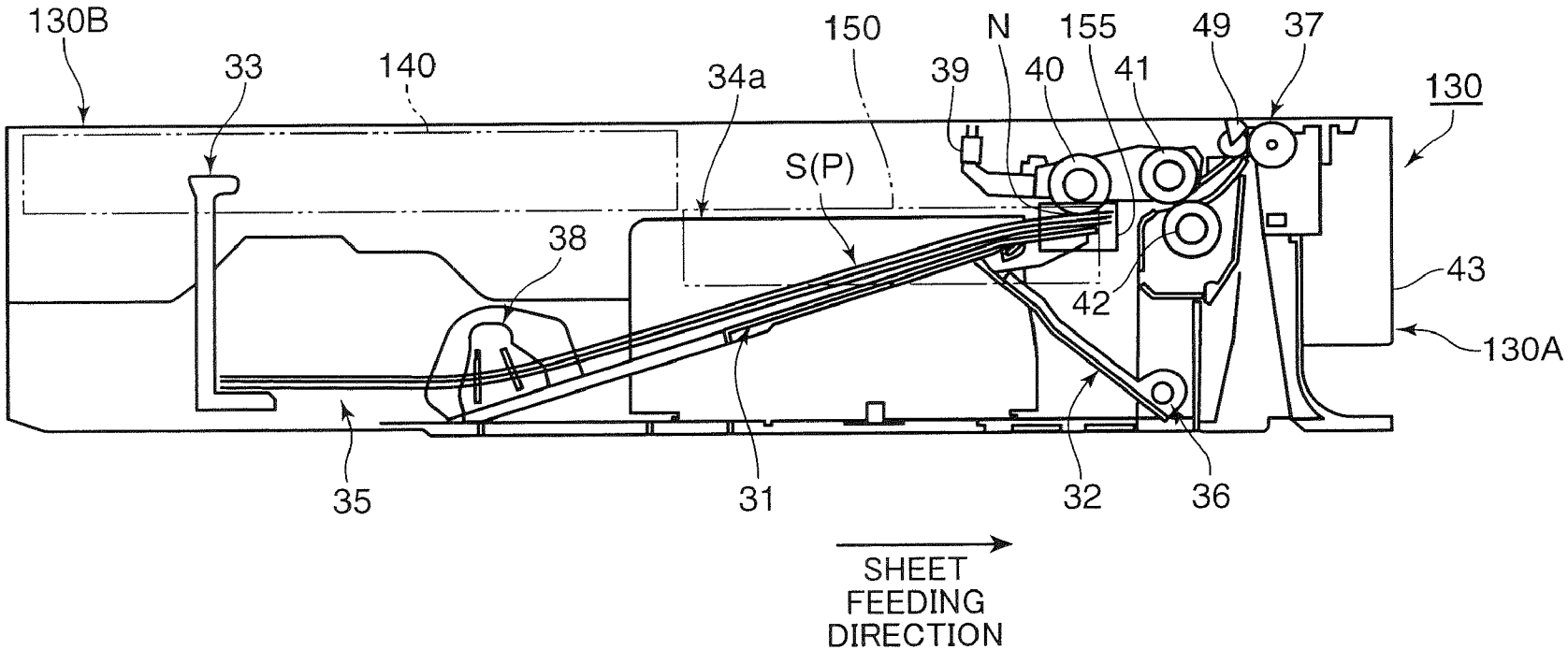
FIG. 3 is a sectional view showing the constitution of a sheet feeding device according to a first embodiment of the present invention.
Figure 4:
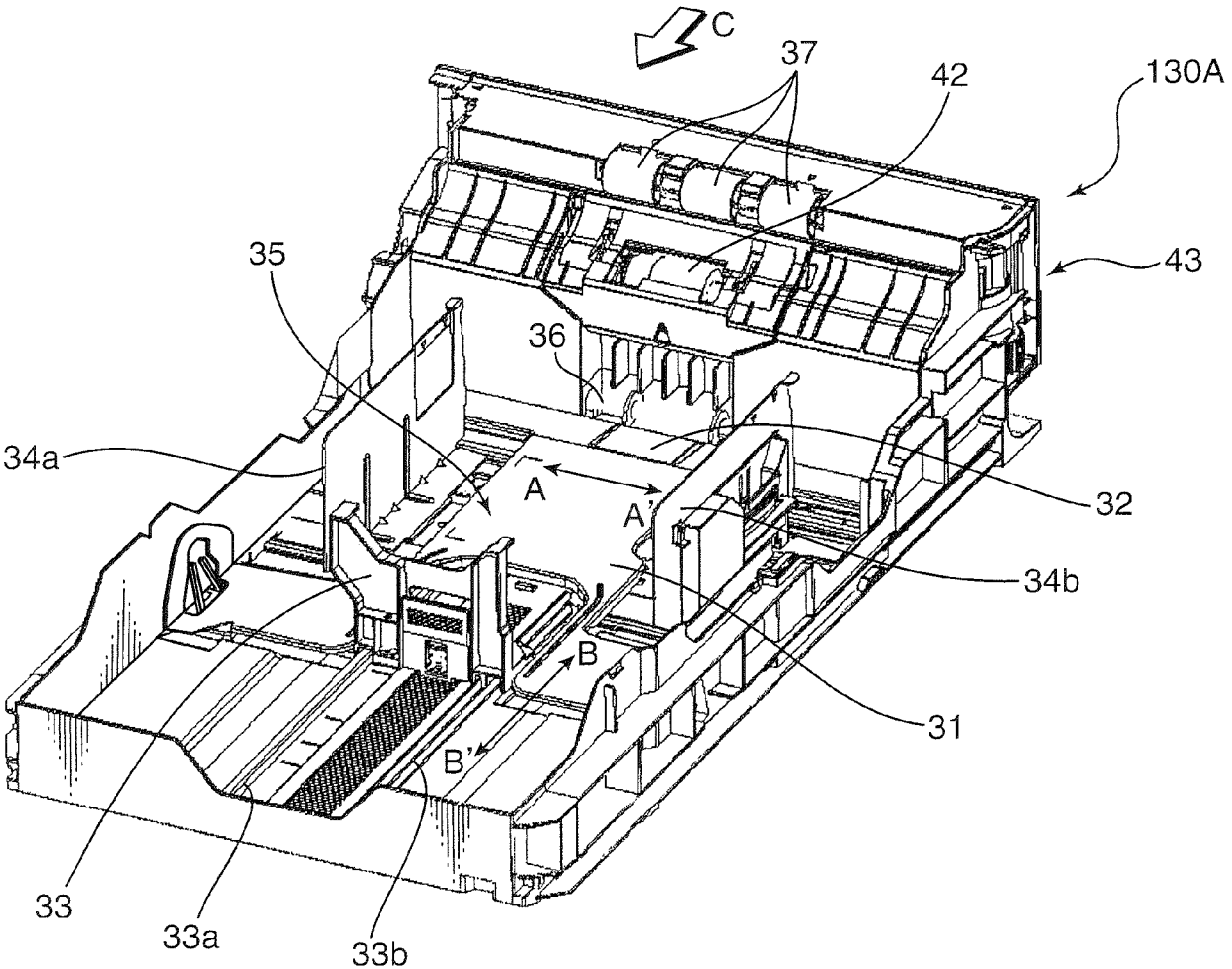
FIG. 4 is a perspective view showing a state in which a sheet feeding cassette of the sheet feeding device shown in FIG. 3 is withdrawn from a sheet feeding device main body.
Figure 5B:
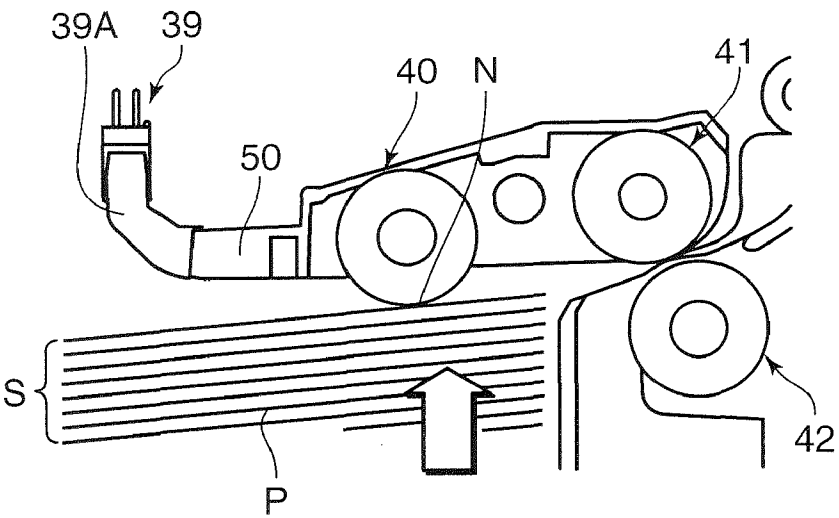
FIGS. 5A and 5B are illustrative views showing a position detection sensor installed in the sheet feeding device.
Figure 5A:
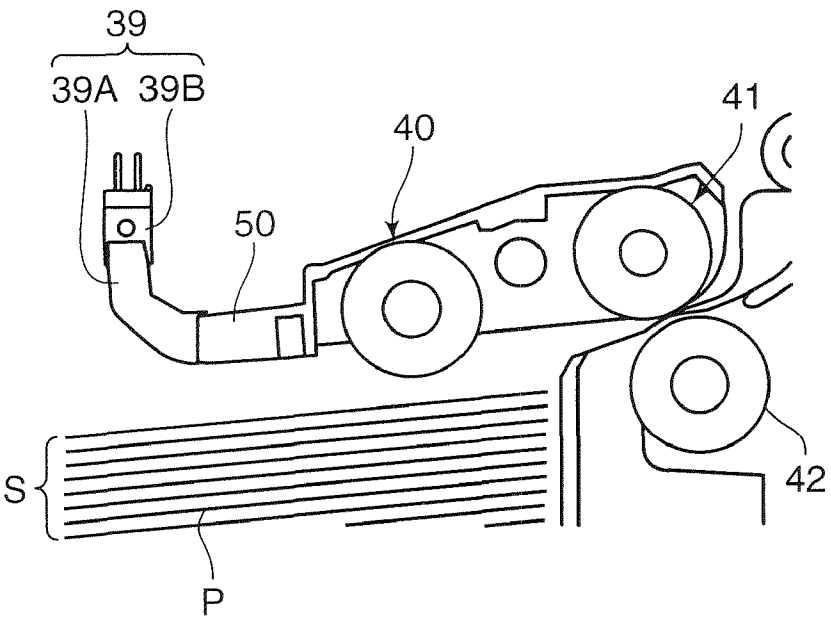

FIG. 3 is a sectional view showing the constitution of the sheet feeding unit 130 (sheet feeding device) according to the first embodiment. FIG. 4 is a perspective view showing a state in which the sheet feeding cassette 130A of the sheet feeding unit 130 is withdrawn from the sheet feeding unit main body 130B. FIGS. 5A and 5B are illustrative views showing a position detection sensor 39 installed in the sheet feeding unit 130.

As shown in FIGS. 3 and 4, a lift plate 31 (sheet carrying plate) for carrying the sheet stack S constituted by a plurality of the sheets P is provided on an inner bottom surface of a sheet accommodating portion 35 of the sheet feeding unit 130. A sheet feeding direction upstream side end (a left side end portion in FIG. 3) of the lift plate 31 is supported rotatably by a support portion 38. In other words, the lift plate 31 can be rotated by the support portion 38 in a vertical plane in the interior of the sheet accommodating portion 35 using a downstream end thereof as a free end. The support portion 38 is provided on wall portions on either side of the sheet accommodating portion 35, which is disposed to face a width direction of the sheet P (an orthogonal direction to the sheet feeding direction).

The sheet feeding cassette 130A of the sheet feeding unit 130 includes a pair of width alignment cursors 34*a*, 34*b* for positioning the sheets P accommodated in the sheet accommodating portion 35 in the width direction, and a rear end cursor 33 for aligning a rear end of the sheets P. The pair of width alignment cursors 34*a*, 34*b* are provided to be capable of performing a reciprocating motion in the sheet width direction (a direction indicated by an arrow AA' in FIG. 4) along respective guide rails, not shown in the drawings. Here, the sheet P is dispatched in a direction indicated by an arrow B in FIG. 4, and therefore the rear end cursor 33 is provided to be capable of performing a reciprocating motion parallel to the sheet conveyance direction (a direction indicated by an arrow BB' in FIG. 4) along guide rails 33*a*, 33*b*. The sheet stack S is accommodated in a predetermined position of the sheet feeding unit 130 once the width alignment cursors 34*a*, 34*b* and the rear end cursor 33 have been moved in accordance with the size of the carried sheets. The sheet feeding unit 130 includes a cassette cover 43, a front surface side (a side seen from a direction indicated by an arrow C in FIG. 4) of which is exposed to the outside to form a part of an outer covering surface of the color printer 1.

Figure 13:
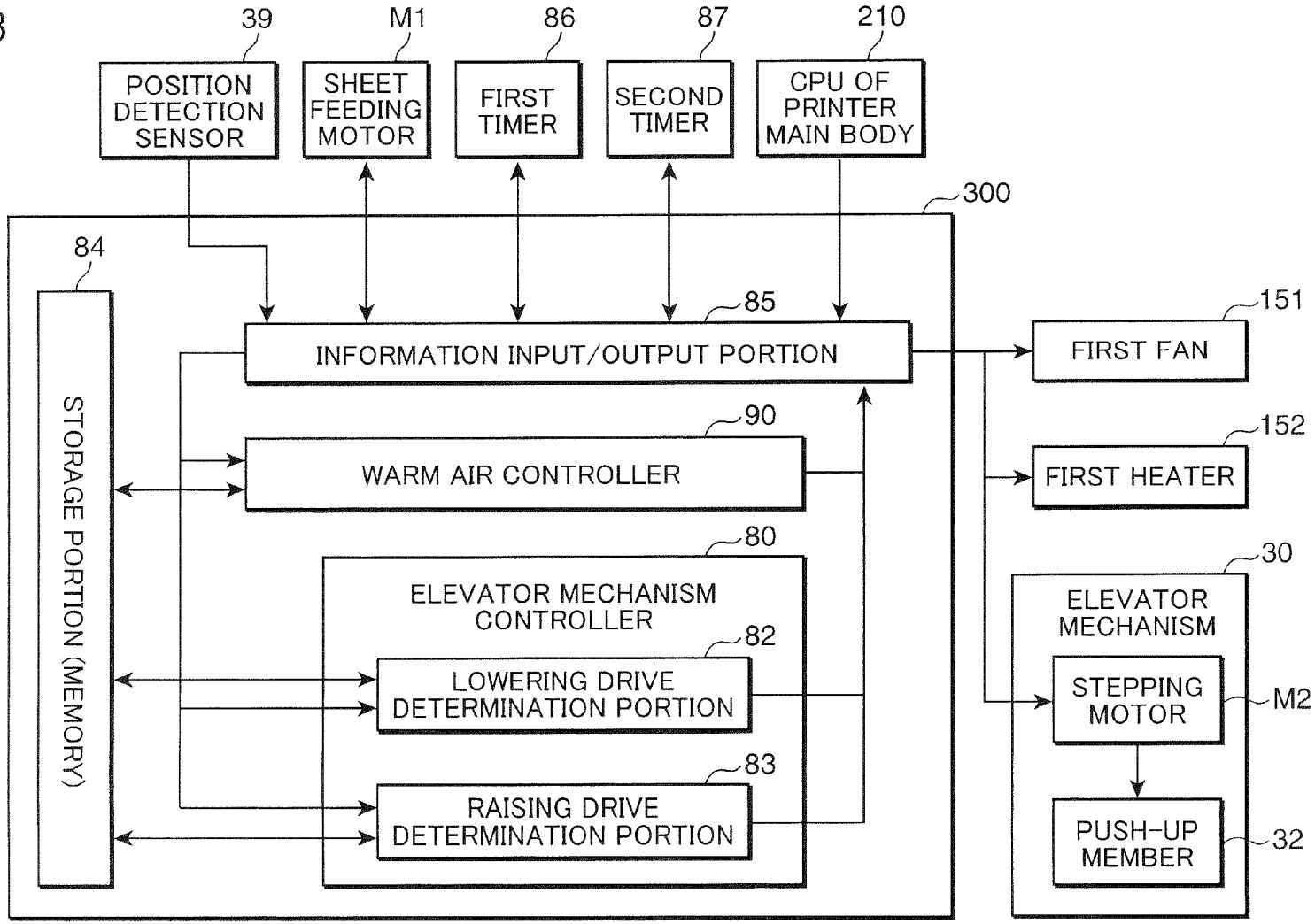
FIG. 13 is a function block diagram showing a controller controlling a warm air blowing operation in the sheet feeding device according to the first embodiment.
Figure 15:
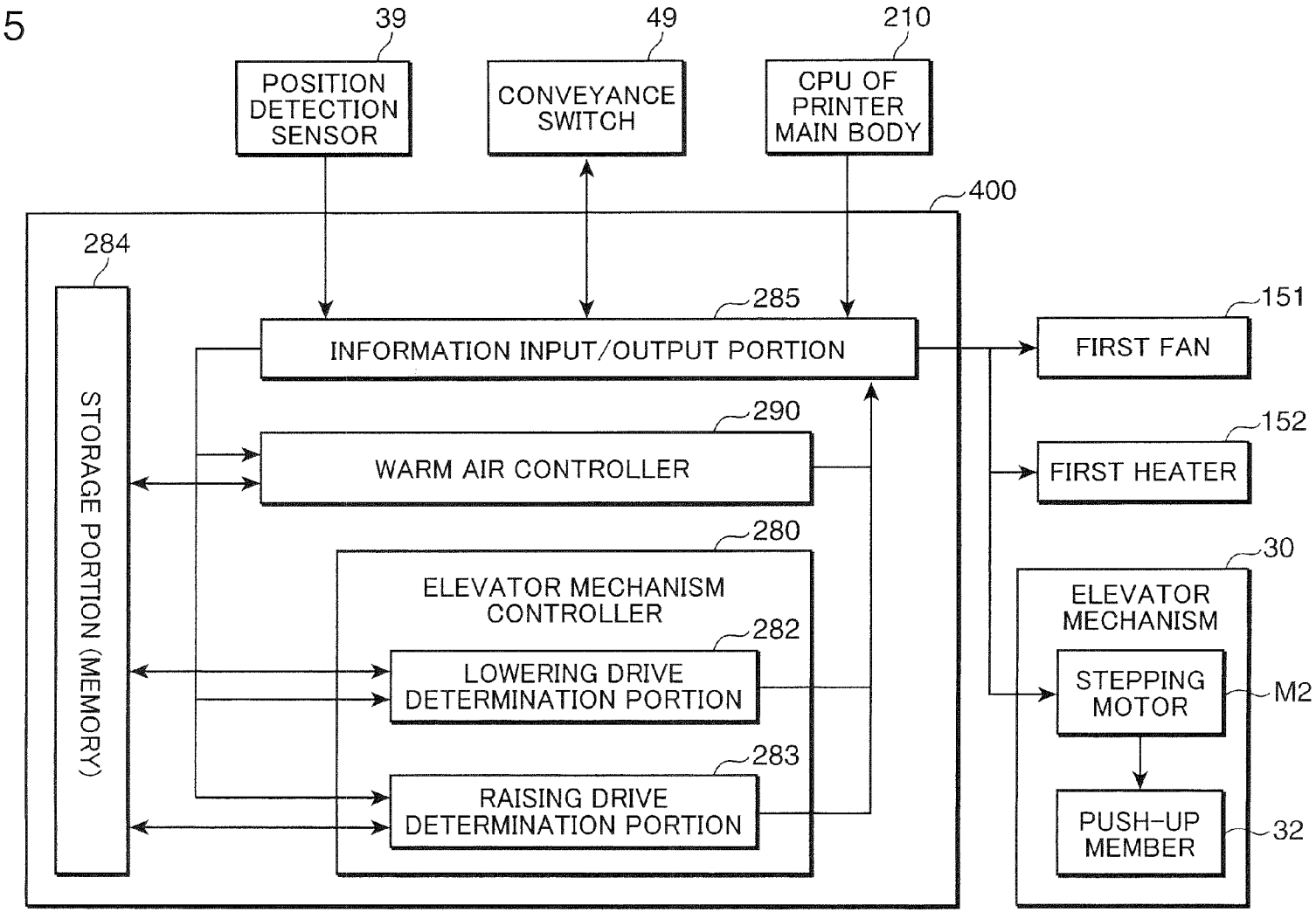
FIG. 15 is a functional block diagram of a controller controlling a warm air blowing operation in a sheet feeding device according to a second embodiment.

A drive shaft 36, a push-up member 32, and a driving connecting member (not shown) are provided below a sheet feeding direction downstream portion of the lift plate 31 as an elevator mechanism 30 for raising and lowering the lift plate 31 (FIGS. 13 and 15). Further, a receiving member (not shown) corresponding to the driving connecting member and a motor (not shown) that is connected to the receiving member and capable of normal and reverse rotation are provided on the sheet feeding unit main body 130B side. When the sheet feeding cassette 130A is accommodated in the sheet feeding unit main body 130B, the driving connecting member of the sheet accommodating portion 35 on the sheet feeding cassette 130A side engages connectedly with the receiving member on the sheet feeding unit main body 130B side. Thus, the power of the motor can be transmitted to the drive shaft 36. The elevator mechanism, which displaces the lift plate 31 between a sheet feeding position (first position) and a withdrawn position (second position) withdrawn from the sheet feeding position, is constituted by the drive shaft 36, the push-up member 32, the driving connecting member, the receiving member, and the motor.

Note that a stepping motor M2, a DC motor or the like shown in FIGS. 13 and 15 can be used as a motor constituting the elevating mechanism 30 for raising and lowering the lift plate 31.

Further, as shown in FIG. 3, the sheet feeding unit 130 includes a sheet feeding roller 41 provided on a conveyance direction downstream side of the pickup roller 40, and a loosening roller 42 provided below the sheet feeding roller 41. Further, a conveyance roller 37 is provided on the conveyance direction downstream side of the pickup roller 40 and the sheet feeding roller 41. The sheet feeding roller 41 is provided on the sheet feeding unit main body 130B side together with the pickup roller 40, whereas the loosening roller 42 and the conveyance roller 37 are provided on the sheet feeding cassette 130A side. When the sheet feeding cassette 130A is attached to the sheet feeding unit main body 130B, the sheet feeding roller 41 contacts the loosening roller 42.

The sheet feeding roller 41 feeds a sheet P extracted from the sheet stack S by the pickup roller 40 to the conveyance roller 37. The sheet feeding roller 41 rotates in a direction for conveying the sheet P downstream, whereas the loosening roller 42 rotates in an opposite direction for returning the sheet P upstream. In a case where a plurality of overlapped sheets P is extracted by the pickup roller 40, the loosening roller 42 can be used to prevent all but the uppermost sheet P from being fed in the direction of the conveyance roller 37, and thus only the uppermost sheet P is conveyed to the conveyance roller 37 by the sheet feeding roller 41. The conveyance roller 37 conveys the sheet P onto the sheet feeding conveyance path 133 (see FIG. 2).

Further, as shown in FIGS. 5A and 5B, the sheet feeding unit 130 includes the position detection sensor 39 for detecting that the uppermost sheet P of the sheet stack S carried on the lift plate 31 is in the sheet feeding position. The position detection sensor 39 is constituted by a light blocking member 39A and an optical sensor 39B. The optical sensor 39B is constituted by a light emitting element provided fixedly in the vicinity of the pickup roller 40, and a light receiving element for receiving light emitted by the light emitting element. The light blocking member 39A is provided on a support member 50 of the pickup roller 40. Further, the support member 50 is provided to be capable of rotating about a rotary axis of the sheet feeding roller 41.

Hence, when the lift plate 31 is raised such that the upper face of the sheet stack S carried on the lift plate 31 moves into the sheet feeding position shown in FIG. 5B, the pickup roller 40 is pushed up by the uppermost sheet P so as to rotate about the rotary axis of the sheet feeding roller 41 and thereby displace slightly upward. At this time, the light blocking member 39A is lifted up in conjunction with the pickup roller 40, thereby blocking an optical path of the optical sensor 39B, and accordingly, it is possible to detect that the upper face of the sheet stack S is in the sheet feeding position.

When the motor is activated in the sheet feeding unit 130 constituted as described above, the push-up member 32 pushes up the downstream end side of the lift plate 31 while remaining engaged with the bottom surface of the lift plate 31. As a result, the upper face of the sheet stack S carried on the lift plate 31 displaces to the sheet feeding position contacting the pickup roller 40 provided above the sheet feeding cassette 130A.

At this time, driving of the motor is stopped when the position detection sensor 39 detects displacement of the pickup roller 40 to the sheet feeding position, as shown in FIG. 5B. Further, when the position detection sensor 39 no longer detects this displacement due to a reduction in the number of sheets P during sheet feeding, the motor is activated to lift the sheet stack S up to the sheet feeding position. Note that in this embodiment, a detected portion (the light blocking member 39A) is provided on the support member 50 of the pickup roller 40, but the present invention is not limited thereto, and the upper face of the sheet stack S may be detected directly in the vicinity of the pickup roller 40 or using a detection mechanism other than an optical sensor, for example.

As shown in FIG. 3 and FIGS. 6 to 9, the sheet feeding unit 130 according to the this embodiment has a lateral warm air mechanism (first warm air mechanism) 150 as a sheet loosening mechanism employing warm air. The lateral warm air mechanism 150 blows warm air onto a side face of the sheet stack S accommodated in the sheet feeding cassette 130A, the side face being parallel to the sheet feeding direction.

Figure 6:
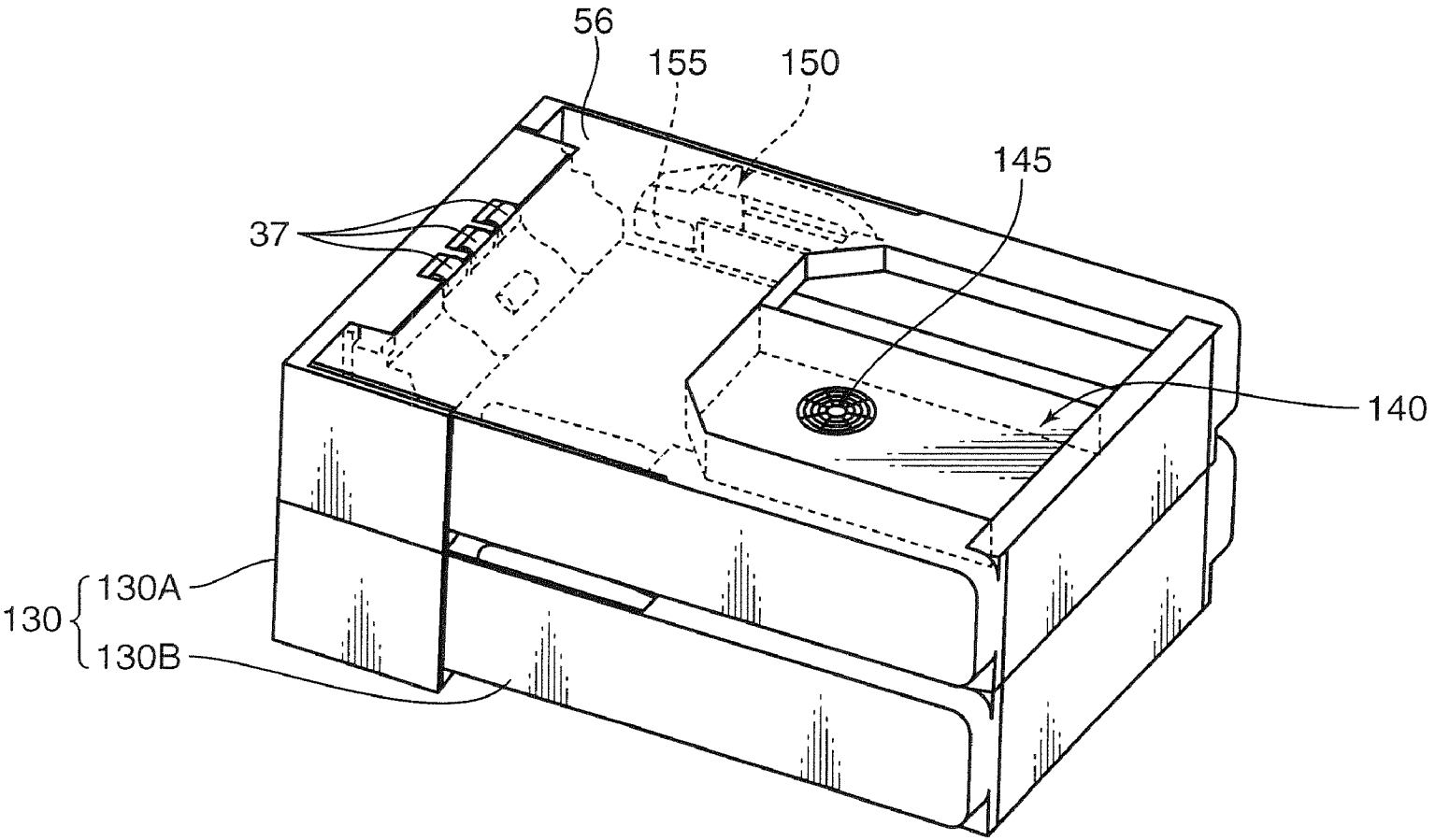
FIG. 6 is a perspective view for illustrating the constitution of the sheet feeding device according to the first embodiment.
Figure 7:
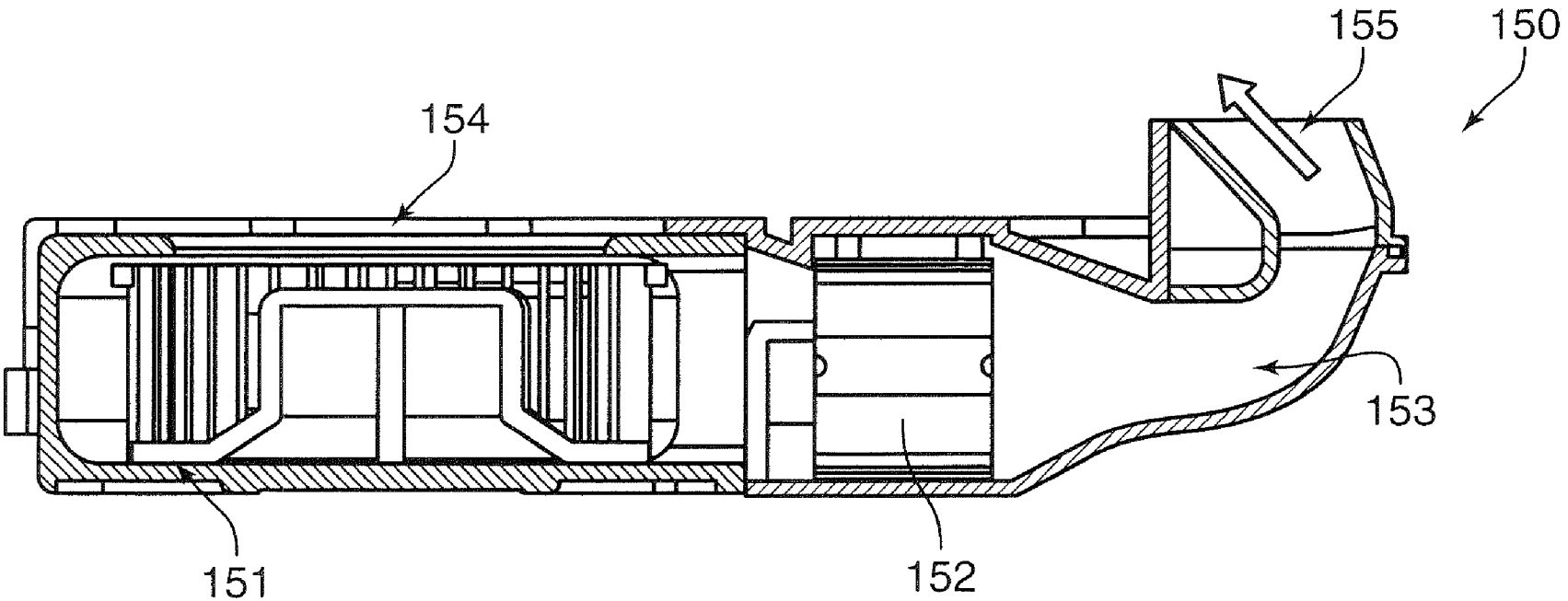
FIG. 7 is a horizontal direction sectional view showing the main parts of a lateral warm air mechanism.
Figure 8:
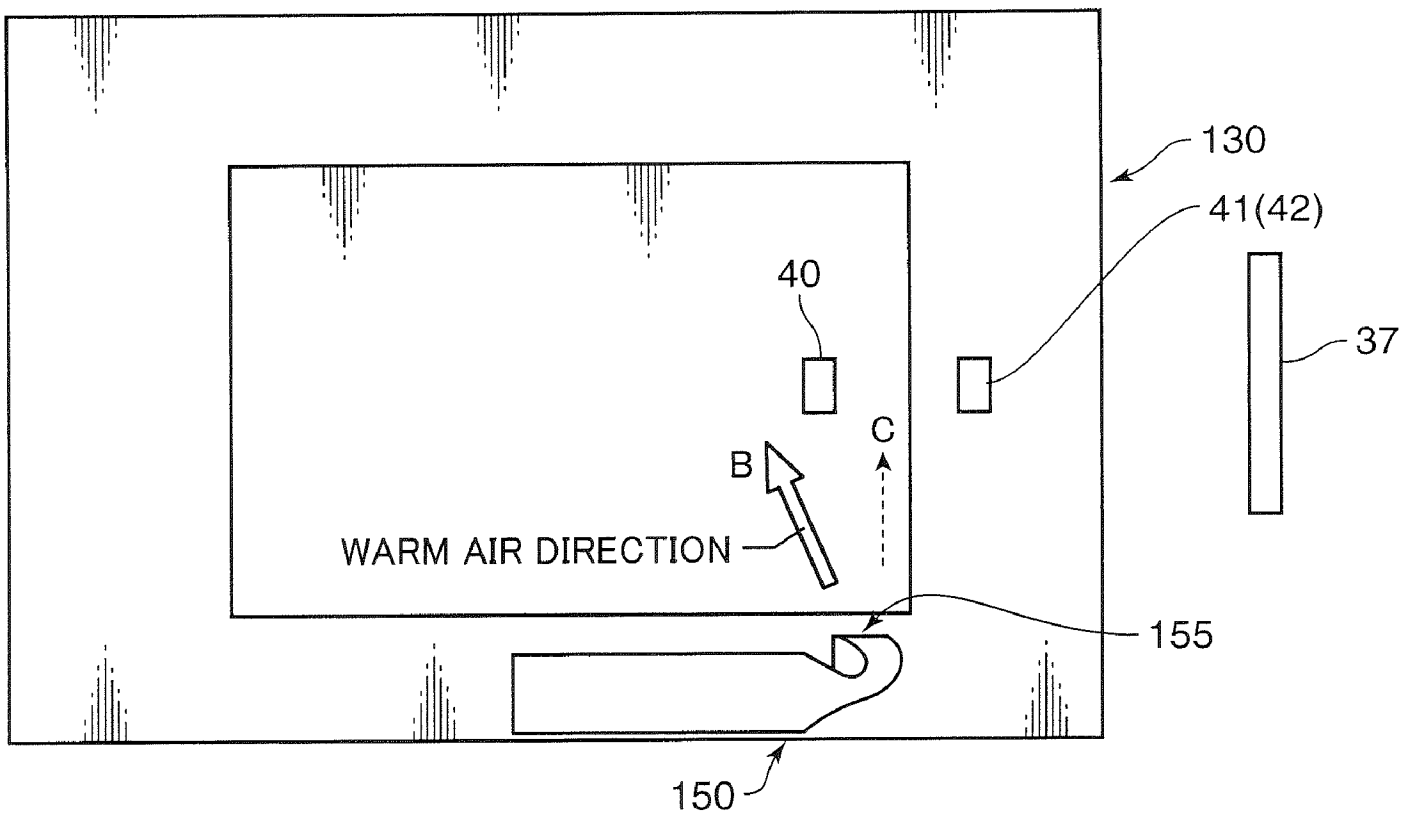
FIG. 8 is an illustrative view showing a warm air blowing direction of the lateral warm air mechanism.
Figure 9B:
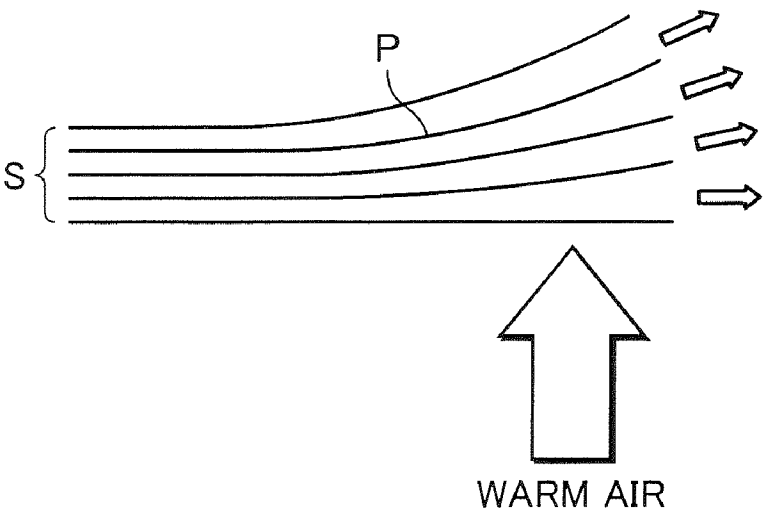
FIGS. 9A and 9B are illustrative views for illustrating a warm air blowing state of the lateral warm air mechanism.
Figure 9A:
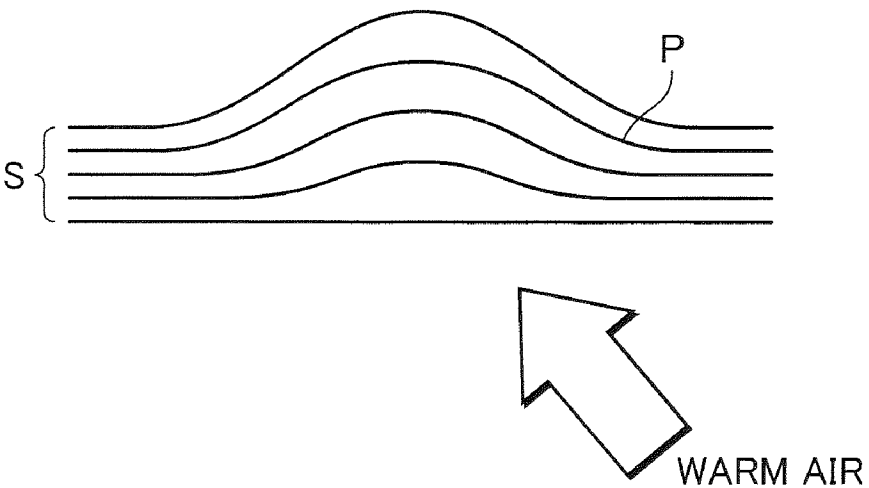

FIG. 6 is a perspective for illustrating the constitution of the sheet feeding unit 130 according to the first embodiment. FIG. 7 is a horizontal direction sectional view showing the main parts of the lateral warm air mechanism 150. FIG. 8 is an illustrative view showing a warm air blowing direction of the lateral warm air mechanism 150. FIGS. 9A and 9B are illustrative view for illustrating a warm air blowing state of the lateral warm air mechanism 150.

The lateral warm air mechanism 150 is provided on the sheet feeding unit main body 130B side. As shown in FIG. 6, a ceiling plate 56 is provided over an upper face of the sheet feeding unit main body 130B such that an upper portion of a sheet accommodating space is sealed by the ceiling plate 56. An opening portion is provided in the ceiling plate 56, and an upper warm air mechanism 140 (second war air unit) described hereinafter is attached to the opening portion.

As shown in FIG. 6, the lateral warm air mechanism 150 is provided along one side face of a sheet feeding cassette 130A in the sheet feeding direction. As shown in FIG. 7, the lateral warm air mechanism 150 includes a first fan 151 and a first heater 152, which are provided in a lateral warm air chamber 153. The lateral warm air mechanism 150 aspirates air from the sheet feeding unit 130 through a first intake port 154 provided in the sheet feeding unit 130. When the first fan 151 is rotated such that the air in the lateral warm air chamber 153 moves to the first heater 152 side, the air in the sheet feeding unit 130 is taken into the lateral warm air chamber 153 through the first intake port 154. The air that moves to the first heater 152 side is heated by the first heater 152 and then blown toward the side face of the sheet stack S through a first warm air blowing port 155.

As shown in FIG. 3, on a vertical cross-section of the sheet conveyance direction, the first warm air blowing port 155 of the lateral warm air mechanism 150 for blowing warm air onto the side face of the sheet stack S in the sheet feeding position is oriented toward a point N at which the pickup roller 40 contacts the upper face of the sheet stack S. Thus, warm air can be applied in a concentrated fashion to the side face of the sheet stack S in exactly the position in which the pickup roller 40 extracts the uppermost sheet, and as a result, warm air can be blown between the sheets in this part efficiently. Hence, the sheet stack S can be loosened efficiently prior to sheet feeding without increasing the size of the lateral warm air mechanism 150.

Moreover, the first warm air blowing port 155 is oriented such that warm air is blown at an angle on a sheet center direction side relative to the width direction of the sheet stack S (an orthogonal direction to the sheet feeding direction, indicated by an arrow C in FIG. 8), as shown by an arrow B in FIG. 8, rather than directly in (parallel to) the width direction of the sheet stack S, as shown in FIG. 8. The reason for this is as follows.

When warm air is blown in the direction of the arrow C in FIG. 8, the warm air escapes to the sheet feeding direction downstream side from the side face of the sheet stack S, as shown in FIG. 9B. As a result, the warm air cannot easily penetrate deeply into the sheet stack S, and therefore the loosening efficiency of the lateral warm air decreases. Hence, in the lateral warm air mechanism 150 according to the this embodiment, the first warm air blowing port 155 is formed to blow warm air toward the center side of the sheet stack S to be fed, as shown by the arrow B in FIG. 8. Thus, as shown in FIG. 9A, the warm air blown from the first warm air blowing port 155 can be trapped between the sheets of the sheet stack S. More specifically, when warm air is blown toward the center side of the sheet stack S, the sheet feeding direction upstream side and downstream side of the sheet stack S sag downward due to the weight of the sheets P, thereby forming a lid, and as a result, the warm air is blown deep into the sheet stack S in a wide range without escaping to the outside. Hence, the sheet stack S can be loosened efficiently prior to sheet feeding using a constant amount of warm air.

Figure 10:
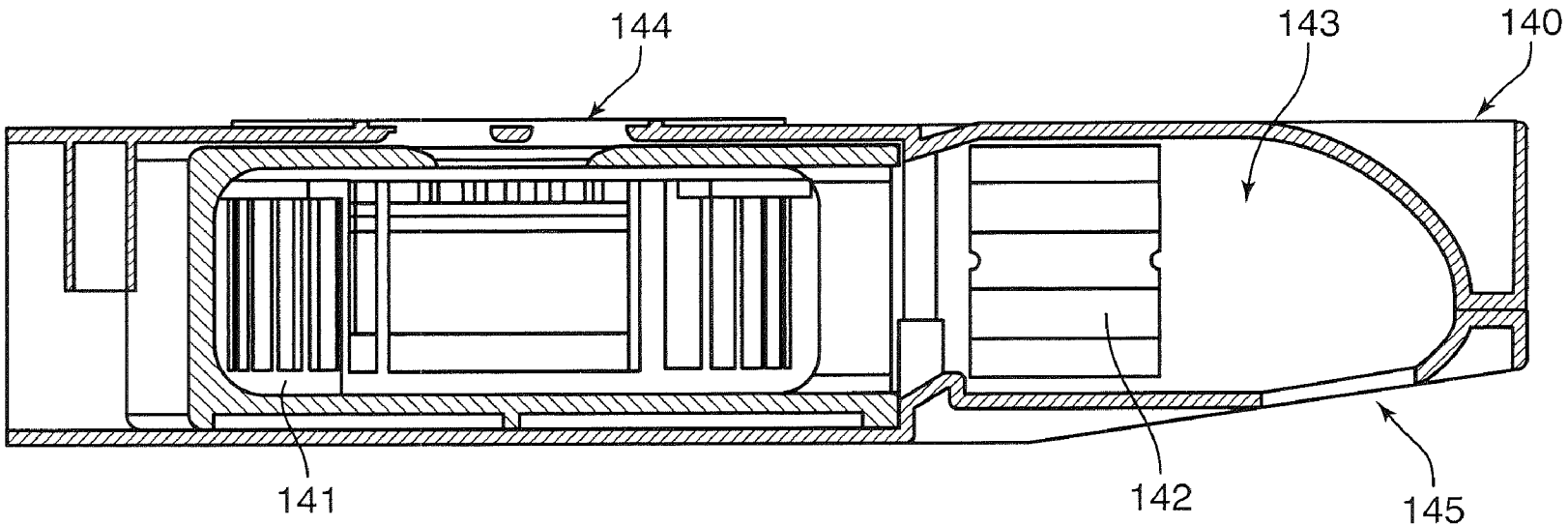
FIG. 10 is a vertical direction sectional view showing the main parts of an upper warm air mechanism.

In addition to the lateral warm air mechanism 150, the sheet feeding unit 130 according to the first embodiment also has the upper warm air mechanism 140 (second war air unit) as a sheet loosening mechanism employing warm air, as shown in FIGS. 2, 3, 6 and 10. FIG. 10 is a vertical direction sectional view showing the constituent of the main parts of the upper warm air mechanism 140.

As with the lateral warm air mechanism 150 described above, the upper warm air mechanism 140 is provided on the sheet feeding unit main bogy 130B side. The upper warm air mechanism 140 takes in air from a second intake port 144, and blows warm air toward the upper face of the sheet stack S accommodated in the sheet accommodating portion 35 from a second warm air blowing port 145 provided above the upper face of the sheet stack S.

A second fan 141 and a second heater 142 are provided within an upper warm air chamber 143 of the upper warm air mechanism 140. The second intake port 144 is provided in an upper face of the upper warm air chamber 143 above the second fan 141. Specifically, when the second fan 141 rotates, air in the upper warm air chamber 143 moves to the second heater 142 side and outside air is taken into the upper warm air chamber 143 through the second intake port 144. The air that moves to the second heater 142 side is heated by the second heater 142 and blown toward the upper face of the sheet stack S through the second warm air blowing port 145 provided in a lower face of the upper warm air chamber 143. The second warm air blowing port 145 is formed in the upper warm air mechanism 140 on a downstream side of the sheet feeding direction when the upper warm air mechanism 140 is attached to the sheet feeding unit 130.

When a predetermined sheet feeding unit 130 is selected during an image formation operation in the constitution described above, the lift plate 31 is driven to rise, whereby the sheet stack S is raised in the direction of the pickup roller 40, and the upper warm air mechanism 140 is driven to blow warm air toward the upper face of the sheet stack S through the second warm air blowing port 145.

Here, the upper face and peripheral part of the sheet stack S are exposed to outside air and are therefore likely to contain a lot of moisture. In other words, the upper face and side faces of the sheet stack S swell due to moisture absorption, whereas the degree of swelling on the inside of the sheet stack S is lower than that of the upper face and side faces due to the smaller amount of moisture. As a result, a phenomenon occurs whereby pressure on the inside (in the inter-sheet spaces) of the sheet stack S turns negative such that the sheets stick together.

However, according to the sheet feeding unit 130 of this embodiment, a relative humidity of the sheet stack S in the sheet feeding unit 130 (the humidity of the upper face and outer peripheral part of the sheet stack S relative to the other parts) can be reduced instantaneously by providing the upper warm air mechanism 140.

Figure 11:
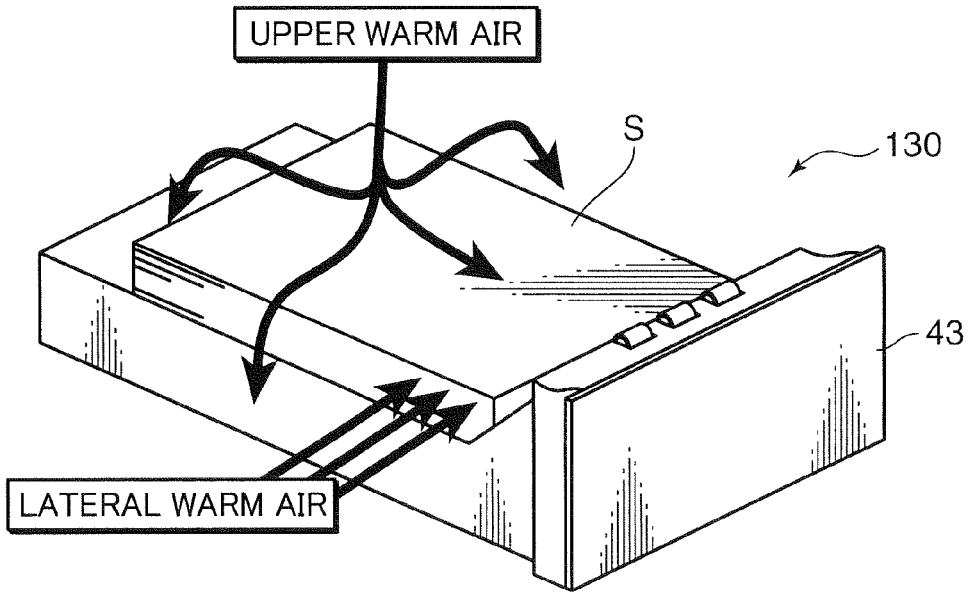
FIG. 11 is a perspective view of a sheet feeding cassette, illustrating lateral warm air and upper warm air blowing directions.

More specifically, the upper warm air mechanism 140 is capable of blowing warm air evenly and in a concentrated fashion from the upper face of the sheet stack S, in which sticking is particularly likely to occur, to the vicinity of the outer periphery (see FIG. 11). As a result, a moisture absorption rate of the upper face and outer peripheral part of the sheet stack S is reduced rapidly, thereby eliminating swelling in these parts. Hence, the relative humidity of the sheet stack S (the humidity of the upper face and outer peripheral part of the sheet stack S relative to the other parts) can be reduced instantly, and negative pressure inside (in the inter-sheet spaces of) the sheet stack S can also be eliminated. Thus, a reduction in sheet sticking force can be achieved, and as a result, the sheet stack S can be loosened efficiently prior to sheet feeding.

Further, as shown in FIG. 3, the upper warm air mechanism 140 is provided on the sheet feeding direction upstream side of the pickup roller 40 and at the rear of the sheet feeding unit 130 in the sheet feeding direction. As noted above, the second warm air blowing port 145 is provided on the sheet feeding direction downstream side of the upper warm air mechanism 140, and therefore warm air can be blown through the second warm air blowing port 145 favorably toward the upper face of the sheet stack S accommodated in the sheet accommodating portion 35.

By disposing the upper warm air mechanism 140 exhibiting high sheet loosening efficiency through effective use of the available space in the sheet feeding unit 130, it is possible to realize a sheet loosening mechanism employing warm air assistance that can be applied to a small sheet feeding device.

More specifically, a constitution in which the sheet stack S carried on the lift plate 31 is raised and lowered using a cantilever elevator mechanism, as in the sheet feeding unit 130 according to this embodiment, is often used in comparatively small sheet feeding devices. When this cantilever elevator mechanism is applied, the sheet feeding direction downstream side on which the pickup roller 40 is provided serves as the side to which the sheet stack S is lifted and the side on which the sheet conveyance mechanism including the pickup roller 40, the sheet feeding roller 41, and so on is provided, and hence little spatial leeway exists. On the other hand, the sheet stack S is not lifted to the sheet feeding direction upstream side, and therefore comparatively large spatial leeway exists on this side. By incorporating the upper warm air mechanism 140 into this space, as in this embodiment, the outer form of the sheet feeding unit 130 does not have to be enlarged to dispose the upper warm air mechanism 140, and therefore the constitution described above can be applied favorably to a small sheet feeding device.

Figure 12C:
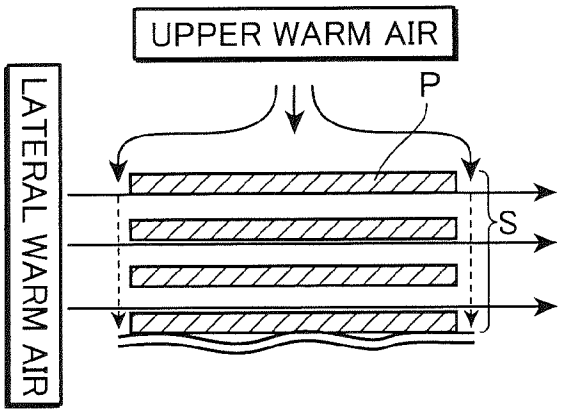
FIGS. 12A, 12B and 12C are illustrative views showing the lateral warm air and upper warm air blowing directions.
Figure 12B:
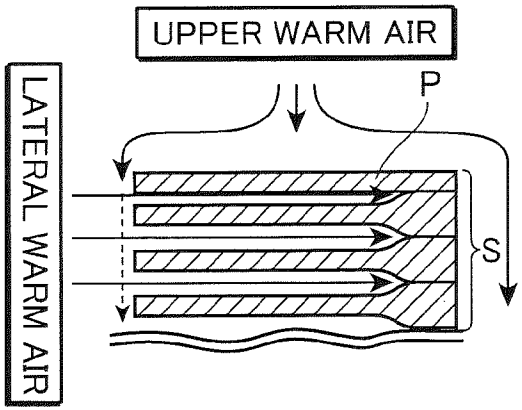
Figure 12A:
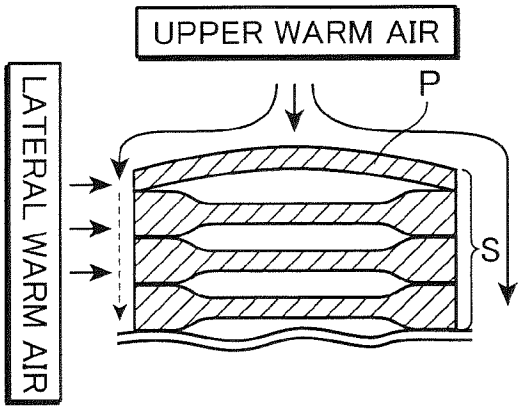

Next, referring to FIGS. 11 to 12C, a sheet loosening effect in the constitution having the lateral warm air mechanism 150 and the upper warm air mechanism 140 is described as the sheet loosening mechanism employing warm air assistance. FIG. 11 is a perspective view of the sheet feeding cassette 130A, illustrating lateral warm air and upper warm air blowing directions. FIGS. 12A to 12C are illustrative views showing the lateral warm air and upper warm air blowing directions with respect to the sheet feeding cassette 130A.

According to the sheet feeding unit 130 of this embodiment, as shown in FIG. 11, warm air is blown toward the upper face of the sheet stack S by the upper warm air mechanism 140 and warm air is blown toward the side face of the sheet stack S in exactly the position in which the pickup roller 40 extracts the uppermost sheet, by the lateral warm air mechanism 150. Hence, in comparison with a constitution including only the lateral warm air mechanism 150, the sheet stack S can be loosened more efficiently prior to sheet feeding.

When a predetermined sheet feeding unit 130 is selected during an image formation operation in the constitution described above, the lift plate 31 is driven to rise, whereby the sheet stack S is raised in the direction of the pickup roller 40, and the upper warm air mechanism 140 is driven to blow warm air toward the upper face of the sheet stack S through the second warm air blowing port 145. Moreover, when a position detection sensor 39 detects that the upper face of the sheet stack S has contacted the pickup roller 40, and therefore that the sheet stack S has risen to the sheet feeding position, the lateral warm air mechanism 150 is driven such that warm air is also blown through the first warm air blowing port 155 toward the side face of the sheet stack S in exactly the position in which the pickup roller 40 extracts the uppermost sheet.

FIGS. 12A to 12C schematically show the degree of efficiency with which the sheet stack S can be loosened by the upper warm air mechanism 140 and the lateral warm air mechanism 150. At first, the upper face and side faces of the sheet stack S are swollen due to moisture absorption, causing the pressure on the inside (in the inter-sheet spaces) of the sheet stack S to turn negative such that the sheets stick together. However, when double warm air blowing is applied by the upper warm air mechanism 140 and the lateral warm air mechanism 150, as shown in FIG. 12A, the condition of the sheet stack S shifts instantly to a state shown in FIG. 12B.

More specifically, the upper warm air mechanism 140 is capable of blowing warm air evenly and in a concentrated fashion from the upper face of the sheet stack S, in which sticking is particularly likely to occur, to the vicinity of the outer periphery. As a result, the moisture absorption rate of the upper face and outer peripheral part of the sheet stack S is reduced rapidly, thereby eliminating swelling in these parts. The swollen state is eliminated first on the upper face of the sheet stack S, which directly receives the warm air blown from the upper warm air mechanism 140, and the side face of the sheet stack S on the lateral warm air mechanism 150 side, which receives warm air from the upper warm air mechanism 140 and the lateral warm air mechanism 150 simultaneously, whereby the state shown in FIG. 12B is achieved, and from this state, the condition of the sheet stack S shifts to a state shown in FIG. 12C (in which the sheet stack S is loosened) instantly.

Hence, when warm air is blown by the upper warm air mechanism 140 and lateral warm air mechanism 150, the swollen state on the side face of the sheet stack S opposite to the lateral warm air mechanism 150 is also eliminated instantaneously, and therefore the warm air from the lateral warm air mechanism 150 passes between the sheets and exits to the exterior of the sheet stack S, thereby loosening the sheet stack S.

Note that the first embodiment describes the constitution in which a combination of a lateral air blowing portion and a heating portion, and a combination or an upper air blowing portion and an upper heating portion are integrally provided in the lateral warm air mechanism 150 and the upper warm air mechanism 140 respectively. However, these members are not necessary provided integrally, and either the air blowing portion or the heating portion may be provided on the sheet feeding cassette 130A and the other on the sheet feeding unit main body 130B.

Figure 14:
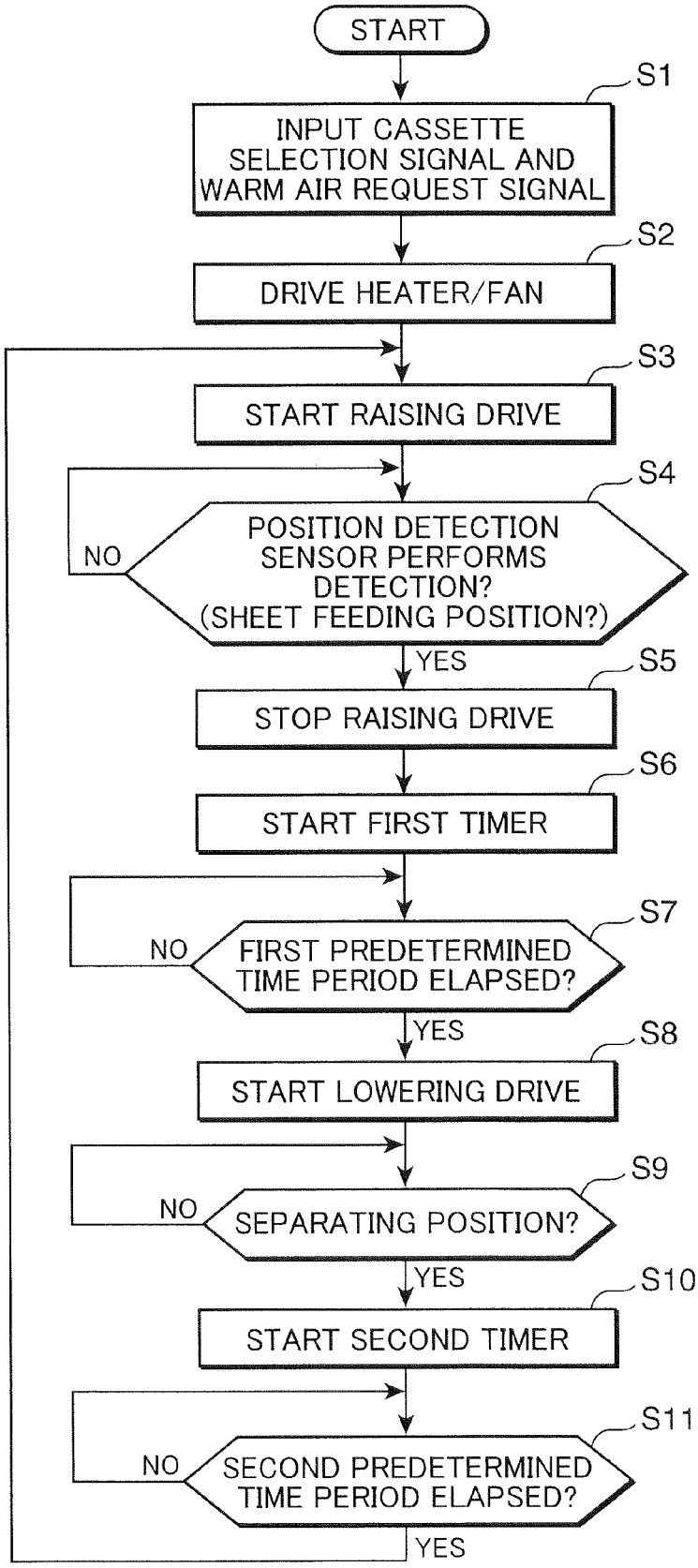
FIG. 14 is a flowchart showing a control operation performed by the controller shown in FIG. 13.
Figure 17:
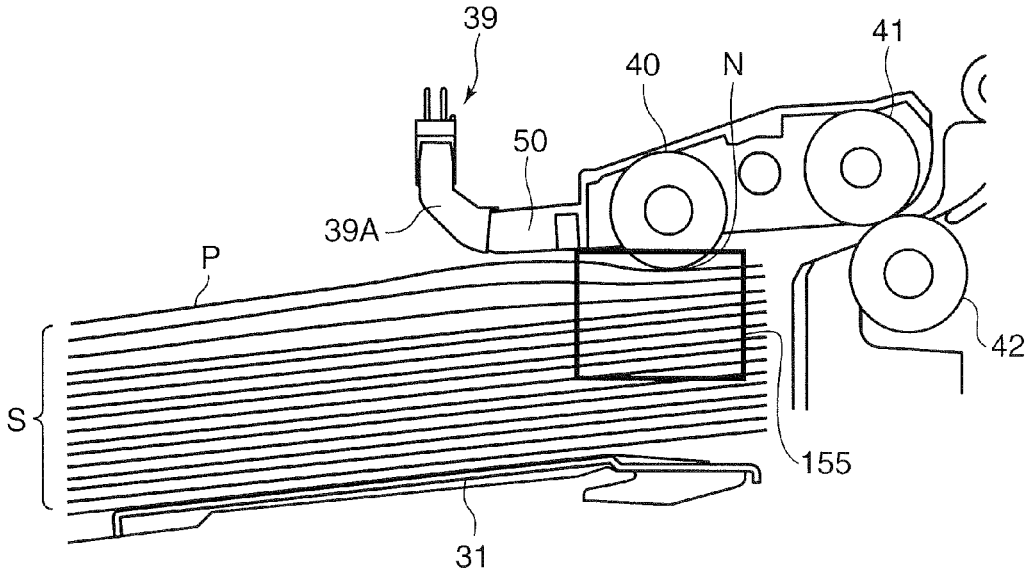
FIGS. 17 to 19 are vertical direction sectional views showing the main parts of a sheet feeding unit, illustrating an operation performed by the sheet feeding devices according to the first and second embodiments.
Figure 18:
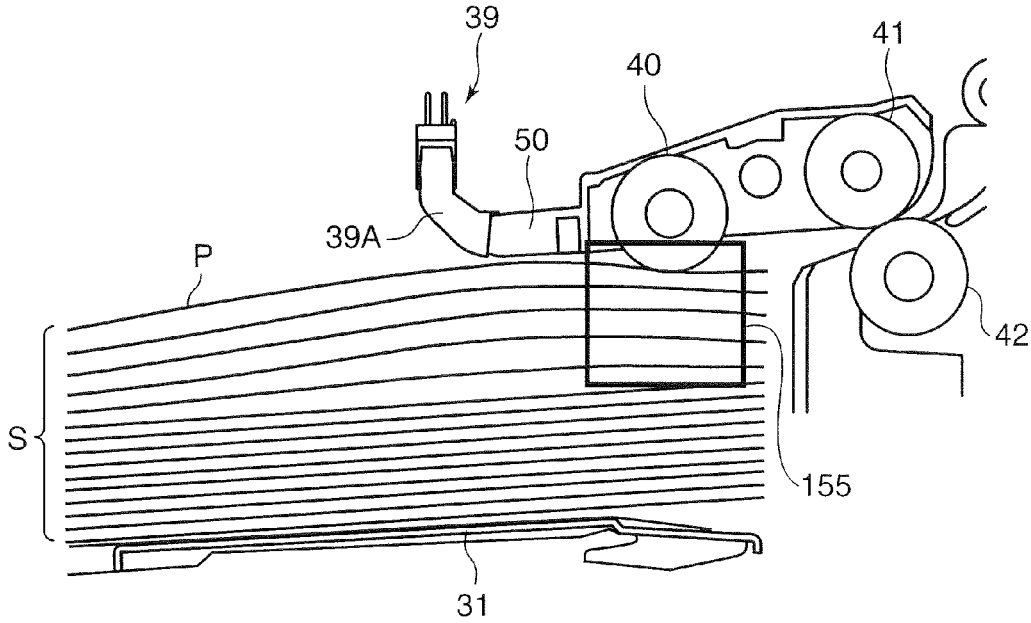
Figure 19:
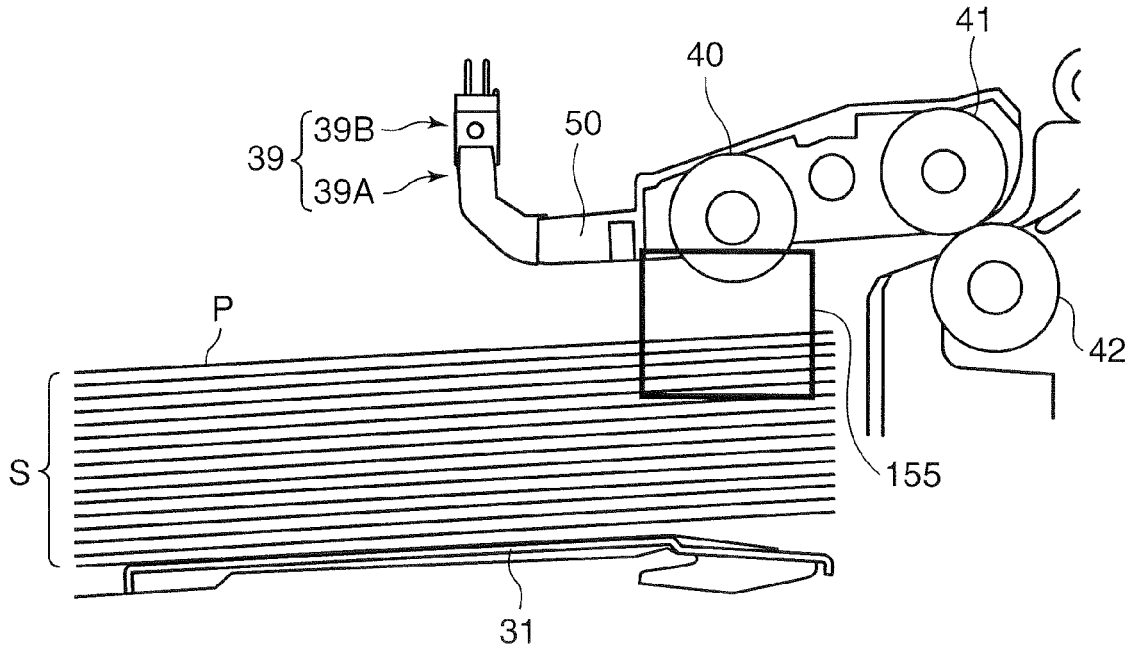

Next, referring to FIGS. 13, 14 and 17 to 19, a control step of a sheet loosening operation employing warm air according to this embodiment will be described. FIG. 13 is a function block diagram showing a controller 300 controlling a warm air blowing operation in the sheet feeding unit 130 according to the first embodiment. FIG. 14 is a flowchart showing a control operation performed by the controller 300 shown in FIG. 13. FIGS. 17 to 19 are vertical direction sectional views showing the main parts of the sheet feeding unit 130, illustrating an operation performed by the sheet feeding unit 130 according to the first embodiment.

As shown in the functional block diagram of FIG. 13, the sheet feeding unit 130 according to this embodiment has the controller 300 for controlling the sheet loosening operation employing warm air, which involves a separating operation for displacing the lift plate 31 between the sheet feeding position and the separating position.

Here, the sheet feeding position is a position in which the upper face of the sheet stack S carried on the lift plate 31 contacts the pickup roller 40, and the separating position is a position in which the upper face of the sheet stack S separates from the pickup roller 40 and in which the sheets on the uppermost layer of the sheet stack S that are likely to stick together are lowered to be positioned within the range of the first warm air blowing port 155.

The controller 300 has an information input/output portion 85, a warm air controller 90, an elevator mechanism controller 80, and a storage portion 84. The controller 300 can be constituted by, for example, a CPU, memories (ROM, RAM and so on), an input interface, and an output interface.

A position detection signal from the position detection sensor 39, a rotation drive start signal of the pickup roller 40 from the sheet feeding motor M1, a first time-up signal from a first timer 86, a second time-up signal from a second timer 87, and a cassette selection signal and warm air request signal from a CPU 210 of the printer main body 200 side are input to the information input/output portion 85.

Here, the first timer 86 is a timer that starts timing from when the pickup roller 40 starts dispatching the sheet P. More specifically, the first timer 86 starts timing as soon as the sheet feeding motor M1 rotating and driving the pickup roller 40 starts activating. Further, once timing a predetermined time period (first predetermined time period) after starting timing, the first timer 86 outputs the first time-up signal. The second timer 87 is a timer that starts timing from when the lift plate 31 (sheet carrying plate) is completely lowered to the separating position. More specifically, the second timer 87 starts timing as soon as the activation of the stepping motor M2 lowering the lift plate 31 to the separating position is stopped. Once timing a predetermined time period (second predetermined time period) after starting timing, the second timer 87 outputs a second time-up signal.

The warm air controller 90 controls the drive of the lateral warm air mechanism 150 and the upper warm air mechanism 140 on the basis of the cassette selection signal and the warm air request signal. Based on these input signals, the warm air controller 90 outputs control signals for driving the lateral warm air mechanism 150 and the upper warm air mechanism 140 to a drive motor (not shown) of each unit through the information input/output portion 285.

The elevator mechanism controller 80 (controller), having a lowering drive determination portion 82 and an raising drive determination portion 83, controls an elevation drive operation performed by the elevator mechanism 30 on the basis of the first time-up signal from the first timer 86 and the second time-up signal from the second timer 87, to cause the elevator mechanism 30 to carry out the separating operation for displacing the lift plate 31 between the sheet feeding position and the separating position.

Based on the first time-up signal from the first timer 86, the lowering drive determination portion 82 outputs a control signal for lowering and driving the push-up member 32, to the stepping motor M2 via the information input/output portion 85. Similarly, based on the second time-up signal from the second timer 87, the raising drive determination portion 83 outputs a control signal for raising and driving the push-up member 32, to the stepping motor M2 via the information input/output portion 85.

The storage portion 84 stores therein a plurality of first and second time-up values of the first and second timers 86 and 87 corresponding to, for example, sheet feeding speed, and the size, material and mode of a selected sheet, the number of drive steps of the stepping motor M2 elevating and driving the push-up member 32, and an operation program of each controller. In addition, the storage portion 84 is provided with a storage area for temporarily storing the determination results and other information.

Next, referring to FIGS. 13 and 14, the control operation performed by the controller 300 will be described. When the cassette selection signal and the warm air request signal are input from the CPU 210 of the printer main body 200 via the information input/output portion 85 (S1), the warm air controller 90 outputs drive signals for driving the first heater 152 and first fan 151 of the lateral warm air mechanism 150, to a drive motor (not shown) of the lateral warm air mechanism 150 via the information input/output portion 85, on the basis of these input signals. As a result, blowing of warm air to the side faces of the sheet stack S that are parallel to the sheet feeding direction begins (S2).

Based on the cassette selection signal and the warm air request signal, the raising drive determination portion 83 of the elevator mechanism controller 80 outputs the control signal for raising and driving the push-up member 32 to the stepping motor M2 via the information input/output portion 85. As a result, raising and driving of the push-up member 32 begins (S3).

Next, based on the position detection signal from the position detection sensor 39 (FIGS. 5 and 17 to 19), the raising drive determination portion 83 determines whether or not the lift plate 31 is raised and driven up to the sheet feeding position (FIG. 17) where the upper face of the sheet stack S carried on the lift plate 31 contacts the pickup roller 40 (S4). The stepping motor M2 continues to raise and drive the push-up member 32 until the lift plate 31 reaches the sheet feeding position. On the other hand, when the raising drive determination portion 83 determines based on the position detection signal that the lift plate 31 is raised to the sheet feeding position (YES in S4), the raising drive determination portion 83 stops the activation of the stepping motor M2, thereby stopping the push-up member 32 from being raised and driven (S5).

When the sheet feeding motor M1 rotating and driving the pick-up roller 40 is activated in this sheet feeding position, the first timer 86 simultaneously start timing (S6) Next, the lowering drive determination portion 82 determines, based on the first time-up signal from the first timer 86, whether the first predetermined time period has elapsed or not (S7). The first timer 86 continues to time until the first predetermined time period elapses, and the lift plate 31 is held at the sheet feeding position. On the other hand, when the lowering drive determination portion 82 determines based on the first time-up signal that the first predetermined time period has elapsed (YES in S7), the lowering drive determination portion 82 outputs the control signal for lowering and driving the push-up member 32, to the stepping motor M2 via the information input/output portion 85. As a result, the stepping motor M2 is activated and lowering and driving of the push-up member 32 begins (S8).

It is desired that the required number of drive steps of the stepping motor M2 be calculated beforehand in order to lower and drive the push-up member 32 and to displace the lift plate 31 from the sheet feeding position to the separating position, and that the number of drive steps be stored in the storage portion 84. Moreover, a plurality of values corresponding to the type, size and printing speed of a selected sheet may be stored in the storage portion 84 as the number of drive steps such that the lowering drive determination portion 82 can read them appropriately from the storage portion 84 in accordance with the selected condition.

Next, the lowering drive determination portion 82 determines whether or not lowering and driving of the push-up member 32 to the separating position of lower the lift plate 31 (FIG. 19) is completed (whether lowering and driving by the predetermined number of steps is completed) (S9). The stepping motor M2 continues to lower and drive the push-up member 32 until the lift plate 31 is lowered to the separating position. On the other hand, when lowering and driving by the predetermined number of steps is completed and the lift plate 31 is lowered to the separating position (YES in S9), the activation of the stepping motor M2 is stopped (lowering and driving is stopped). Simultaneously with this stoppage, the second timer 87 starts timing (S10).

Next, the raising drive determination portion 83 determines based on the second time-up signal from the second timer 87 whether the second predetermined time period has elapsed or not (S11). The second timer 87 continues to time until the second predetermined time period elapses, and the lift plate 31 is held at the separating position. On the other hand, when the raising drive determination portion 83 determines based on the second time-up signal that the second predetermined time period has elapsed (YES in S11), the raising drive determination portion 83 outputs the control signal for raising and driving the push-up member 32, to the stepping motor M2 via the information input/output portion 85. As a result, the stepping motor M2 is activated and raising and driving of the push-up member 32 begins. In other words, the control sequence returns to the step S3 and the steps described above are repeated.

It is desired that the required number of drive steps of the stepping motor M2 be calculated beforehand in order to raise and drive the push-up member 32 and to displace the lift plate 31 from the separating position to the sheet feeding position, and that the number of drive steps be stored in the storage portion 84. Moreover, a plurality of values corresponding to the type, size and printing speed of a selected sheet may be stored in the storage portion 84 as the number of drive steps such that the raising drive determination portion 83 can read them appropriately from the storage portion 84 in accordance with the selected condition.

Note that in the first embodiment the timing of raising and driving the lift plate 31 from the separating position by means of the push-up member 32 is controlled at a timer value obtained upon stopping the lowering and driving (upon completion of the lowering and driving). Instead, the timing may be controlled at a timer value obtained upon starting of the lowering and driving or at a timer value obtained upon starting of sheet feeding (upon starting of the rotation of the sheet feeding motor M1 driving the pickup roller 40).

According to the first embodiment, as shown in FIGS. 17 to 19, the elevator mechanism controller 80 is used to lower the lift plate 31, which is raised to the sheet feeding position (FIG. 17) where the upper face of the sheet stack S contacts the pickup roller 40, to a state shown in FIG. 18 and further to the separating position (FIG. 19) where the upper face of the sheet stack S separates from the pickup roller 40, and thereafter the lift plate 31 is raised and driven to the sheet feeding position again. Therefore, warm air from the lateral warm air mechanism 150 can be blown to the side faces of the sheet stack S that are parallel to the sheet feeding direction, while performing the separating operation for displacing the lift plate 31 between the sheet feeding position and the separating position.

More specifically, because the upper face of the sheet stack S is pressed against the pickup roller 40 at the sheet feeding position, as shown in FIG. 17, the space between the sheets is narrow. For this reason, even when warm air is blown at the sheet feeding position toward the side faces of the sheet stack S that are parallel to the sheet feeding direction, the warm air cannot be applied easily to a section far away from the warm air blowing port 155. Thus, in this embodiment, air blow control is performed to carry out the separating operation described above during the lateral warm air blowing period of the lateral warm air mechanism 150. Because the space between the sheets of the sheet stack S can be increased by performing this separating operation, warm air in a spot form can be blown easily toward the section far away from the warm air blowing port 155. Hence, a lateral warm air mechanism that has a higher sheet loosening efficiency than a conventional large lateral warm air assistance can be realized, thereby achieving reduction in size of the entire sheet feeding device.

When continuously feeding a plurality of sheets, it is necessary to realize the sheet loosening effect employing warm air that involves the separating operation according to this embodiment, while maintaining a desired sheet feeding conveyance speed. Thus, it is desired that the timing of starting lower and driving performed by the elevator mechanism 30 be controlled such that the lift plate 31 is lowered at the earliest timing at which stable sheet conveyance can be ensured.

When the lift plate 31 is lowered before the sheets P on the uppermost layer fed from the pickup roller 40 are placed on a stable conveyance path, the sheets P are shifted, causing a paper jam. However, when the lift plate 31 is lowered too late, the upper face of the sheet stack S is pressed against the pickup roller 40 for a long time, whereby an adequate sheet loosening effect employing warm air that involves the separating operation cannot be obtained.

For example, a time period until the front end of a sheet P fed from the pickup roller 40 passes between a pair of loosening rollers 41, 42 (the sheet feeding roller 41, the loosening roller 42) provided on the conveyance direction downstream side is taken as the first predetermined time period. When the conveyance of the sheet P fed from the pickup roller 40 is delayed, the sheet P cannot be held by either one of the pair of rollers, and therefore a stable sheet feeding state cannot be maintained.

On the other hand, a time period between when the sheet P passes the pair of loosening rollers 41, 42 and when the sheet P is conveyed to the conveyance roller pair 37 (see FIG. 3) provided on the downstream side of the loosening roller pair 41, 42 is taken as the first predetermined time period. Even when the sheet P is separated from the pickup roller 40, the front end of the sheet P is held between the conveyance roller pair 37, while the rear of the sheet P is held between the loosening roller pair 41, 42. In this state, the stable sheet feeding state can be maintained, in comparison with a state in which the sheet P is held only between the loosening roller pair 41, 42. Moreover, even when the conveyance of the sheet P fed from the pickup roller 40 is delayed, the sheet P is held between at least the loosening roller pair 41, 42. Hence, the problem where the sheets are shifted hardly occurs.

In this manner, the first predetermined time period set by the first timer 86 (the time period during which the lift plate 31 is held at the sheet feeding position) is set at a time period required for the sheet P to reach the conveyance roller pair 37 from the pickup roller 40. As a result, lowering of the lift plate 31 can be started at the earliest timing at which a stable conveyance of the sheet P can be ensured. Consequently, by blowing warm air by means of the separating operation, the sheet stack can be loosened more efficiently prior to sheet feeding.

Further, in this embodiment, the first timer 86 and the second timer 87 are used to control lowering drive start timing of lowering the lift plate 31 from the sheet feeding position to the separating position, as well as raising drive start timing of raising the lift plate 31 from the separating position to the sheet feeding position. Thus, the lowering/raising start timing can be adjusted easily to obtain optimum timings, by appropriately changing/adjusting the first time-up values of the first timer 86 and the second time-up values of the second timer 87 in accordance with the sheet feeding speed (image formation speed) of each sheet feeding unit 130 and the material of the sheet.

Note that the control operation above has described the case in which the lateral warm air mechanism 150 is used as the sheet loosening mechanism employing warm air, but the combined use of the lateral warm air mechanism 150 and the upper warm air mechanism 140 can achieve a more efficient sheet loosening effect prior to sheet feeding.

Second Embodiment

Figure 16:
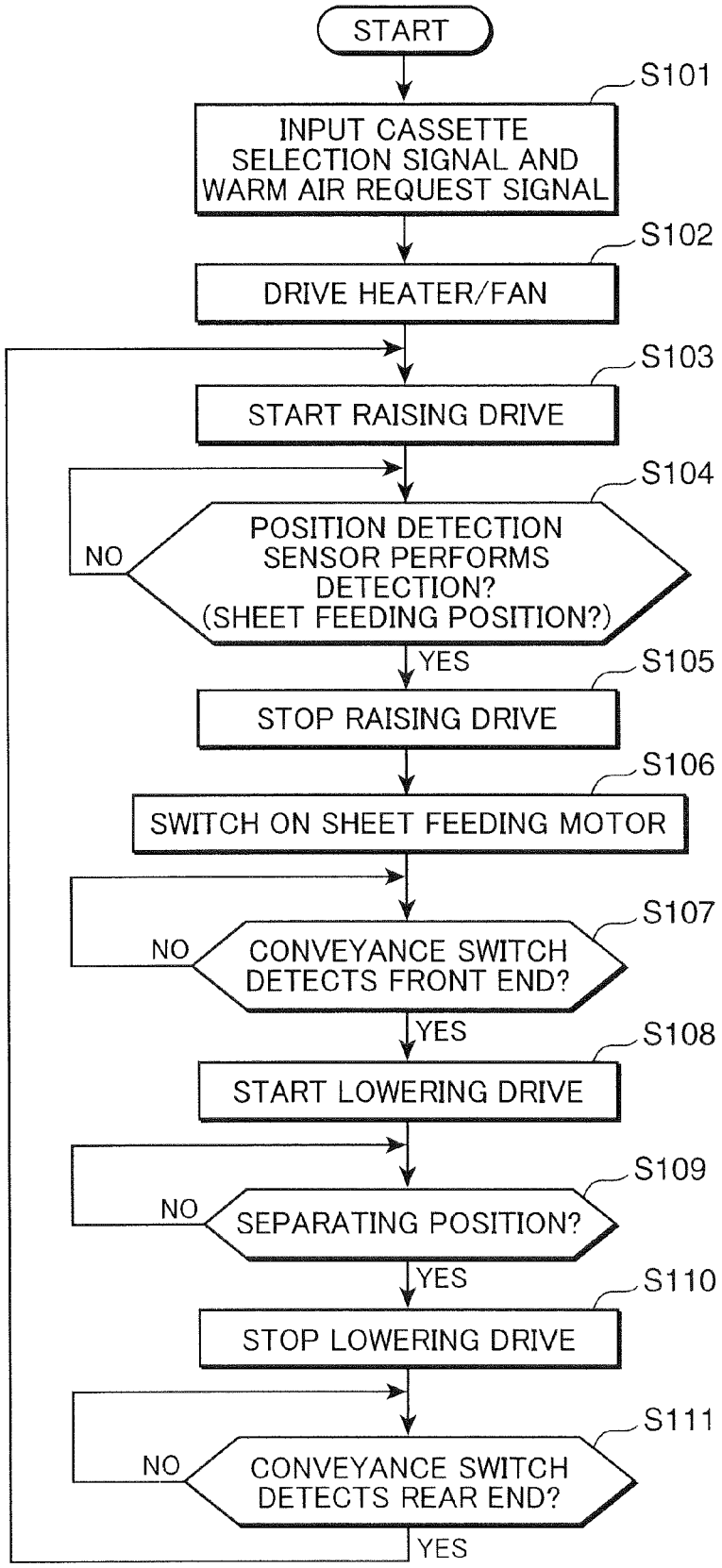
FIG. 16 is a flowchart showing a control operation performed by the controller shown in FIG. 15.

A sheet feeding unit according to a second embodiment will be described next with reference to FIGS. 15 to 19. FIG. 15 is a functional block diagram of a controller 400 according to the second embodiment. FIG. 16 is a flowchart showing a control operation performed by the controller 400 shown in FIG. 15. Note that for ease of description, identical members to the members illustrated in the drawings of the previous embodiment have been allocated identical reference symbols, and description thereof has been omitted. The controller 400 according to the second embodiment is applied to the sheet feeding unit 130 described in the first embodiment.

The sheet feeding unit 130 is provided with a conveyance switch 49 on the sheet direction upstream side of the conveyance roller pair 37 and adjacent to the conveyance roller pair 37 (see FIG. 3). In the first embodiment described above, the timing of lowering or raising and driving the lift plate 31 by means of the push-up member 32 is controlled based on the first time-up signal of the first timer 86 and the second time-up signal of the second timer 87. The second embodiment is different from the first embodiment in that in the second embodiment the timing of lowering or raising and driving the push-up member 32 for displacing the lift plate 31 between the sheet feeding position and the separating position is controlled based on a first detection signal and a second detection signal of the conveyance switch 49 (using both a front end detection portion and a rear end detection portion).

The first detection signal is a signal that is generated when the conveyance switch 49 detects that the front end of a sheet fed by the pickup roller 40 in the sheet feeding direction passes between the conveyance roller pair 37. The second detection signal is a signal that is generated when the conveyance switch 49 detects that the rear end of the sheet fed by the pickup roller 40 in the sheet feeding direction passes between the conveyance roller pair 37.

As shown in the functional block diagram of FIG. 15, the sheet feeding unit 130 according to the second embodiment has the controller 400 that controls the sheet loosening operation with warm air that involves the separating operation for displacing the lift plate 31 between the sheet feeding position and the separating position by means of the push-up member 32. The controller 400 has an information input/output portion 285, a warm air controller 290, an elevator mechanism controller 280, and a storage portion 284.

A position detection signal from the position detection sensor 39, a first detection signal and a second detection signal from the conveyance switch 49, and the cassette selection signal and warm air request signal from the CPU 210 of the printer main body 200 are input to the information input/output portion 285.

The warm air controller 290 controls the drive of the lateral warm air mechanism 150 and the upper warm air mechanism 140 on the basis of the cassette selection signal and the warm air request signal. Based on these input signals, the warm air controller 290 outputs control signals for driving the lateral warm air mechanism 150 and the upper warm air mechanism 140 to a drive motor (not shown) of each unit through the information input/output portion 285.

The elevator mechanism controller 280, having a lowering drive determination portion 282 and an raising drive determination portion 283, controls an elevation drive operation performed by the elevator mechanism 30 on the basis of the first detection signal and the second detection signal from the conveyance switch 49, to cause the elevator mechanism 30 to carry out the separating operation for displacing the lift plate 31 between the sheet feeding position and the separating position.

Based on the first detection signal from the conveyance switch 49 functioning as a front end detection portion, the lowering drive determination portion 282 outputs a control signal for lowering and driving the push-up member 32, to the stepping motor M2 via the information input/output portion 285. Similarly, based on the second detection signal from the conveyance switch 49 functioning as a rear end detection portion, the raising drive determination portion 283 outputs a control signal for raising and driving the push-up member 32, to the stepping motor M2 via the information input/output portion 285.

The storage portion 284 stores therein the number of drive steps of the stepping motor M2 elevating and driving the lift plate 31 corresponding to, for example, the size, material and mode of a selected sheet, and an operation program of each controller. In addition, the storage portion 284 is provided with a storage area for temporarily storing the determination results and other information.

Next, referring to FIGS. 15 and 16, the control operation performed by the controller 400 according to the second embodiment will be described. When the cassette selection signal and the warm air request signal are input from the CPU 210 of the printer main body 200 via the information input/output portion 285 (S101), the warm air controller 290 outputs drive signals for driving the first heater 152 and first fan 151 of the lateral warm air mechanism 150, to a drive motor (not shown) of the lateral warm air mechanism 150 via the information input/output portion 285, on the basis of these input signals. As a result, blowing of warm air to the side faces of the sheet stack S that are parallel to the sheet feeding direction begins (S102).

Based on the cassette selection signal and the warm air request signal, the raising drive determination portion 283 outputs the control signal for raising and driving the push-up member 32 to the stepping motor M2 via the information input/output portion 285. As a result, raising and driving of the push-up member 32 begins (S103). Next, based on the position detection signal from the position detection sensor 39 (FIGS. 5 and 17 to 19), the raising drive determination portion 283 determines whether or not the lift plate 31 is raised and driven up to the sheet feeding position (FIG. 17) where the upper face of the sheet stack S carried on the lift plate 31 contacts the pickup roller 40 (S104). The stepping motor M2 continues to raise and drive the push-up member 32 until the lift plate 31 reaches the sheet feeding position. On the other hand, when the raising drive determination portion 283 determines based on the position detection signal that the lift plate 31 is raised to the sheet feeding position (YES in S104), the raising drive determination portion 283 stops the activation of the stepping motor M2, thereby stopping the push-up member 32 from being raised and driven (S105).

When the sheet feeding motor M1 rotating and driving the pick-up roller 40 is activated in this sheet feeding position, a sheet feeding operation for feeding the sheet P begins (S106). Next, the lowering drive determination portion 282 determines, based on the first detection signal from the conveyance switch 49, whether the front end of the sheet P has reached the conveyance roller pair 37 or not (S107). The lift plate 31 is held at the sheet feeding position until the lowering drive determination portion 282 determines that the front end of the sheet P has reached the conveyance roller pair 37.

On the other hand, when the lowering drive determination portion 282 determines based on the first detection signal that the front end of the sheet P has reached the conveyance roller pair 37 (YES in S107), the lowering drive determination portion 282 outputs the control signal for lowering and driving the push-up member 32, to the stepping motor M2 via the information input/output portion 285. As a result, the stepping motor M2 is activated and the push-up member 32 is lowered and driven (S108).

It is desired that the required number of drive steps of the stepping motor M2 be calculated beforehand in order to lower and drive the push-up member 32 and to displace the lift plate 31 from the sheet feeding position to the separating position, and that the number of drive steps be stored in the storage portion 284. Moreover, a plurality of values corresponding to the type, size and printing speed of a selected sheet may be stored in the storage portion 284 as the number of drive steps such that the lowering drive determination portion 282 can read them appropriately from the storage portion 284 in accordance with the selected condition.

Next, the lowering drive determination portion 282 determines whether or not lowering and driving of the push-up member 32 is completed to lower the lift plate 31 to the separating position (FIG. 19) (whether lowering and driving by the predetermined number of steps is completed) (S109). The stepping motor M2 continues to lower and drive the push-up member 32 until the lift plate 31 is lowered to the separating position. On the other hand, when lowering and driving by the predetermined number of steps is completed and the lift plate 31 is lowered to the separating position (YES in S109), the activation of the stepping motor M2 is stopped (lowering and driving is stopped) and lowering and driving of the lift plate 31 by means of the push-up member 32 is stopped (S110).

Next, the raising drive determination portion 283 determines, based on the second detection signal from the conveyance switch 49 functioning as the rear end detection portion, whether the rear end of the sheet P has reached the conveyance roller pair 37 or not (S111). The lift plate 31 is held at the separating position until the raising drive determination portion 283 determines that the rear end of the sheet P reaches the conveyance roller pair 37. On the other hand, when the raising drive determination portion 283 determines based on the second detection signal that the rear end of the sheet P has reached the conveyance roller pair 37 (YES in S111), the raising drive determination portion 283 outputs the control signal for raising and driving the push-up member 32, to the stepping motor M2 via the information input/output portion 285. As a result, the stepping motor M2 is activated and raising and driving of the push-up member 32 begins. In other words, the control sequence returns to the step S103 and the steps described above are repeated.

It is desired that the required number of drive steps of the stepping motor M2 be calculated beforehand in order to raise and drive the push-up member 32 and to displace the lift plate 31 from the separating position to the sheet feeding position, and that the number of drive steps be stored in the storage portion 284. Moreover, a plurality of values corresponding to the type, size and printing speed of a selected sheet may be stored in the storage portion 284 as the number of drive steps such that the raising drive determination portion 283 can read them appropriately from the storage portion 284 in accordance with the selected condition.

According to the second embodiment, the elevator mechanism controller 280 is used to lower the lift plate 31, which is raised to the sheet feeding position (FIG. 17) where the upper face of the sheet stack S contacts the pickup roller 40, to the state shown in FIG. 18 and further to the separating position (FIG. 19) where the upper face of the sheet stack S separates from the pickup roller 40, and thereafter the lift plate 31 is raised and driven to the sheet feeding position again. Therefore, warm air from the lateral warm air mechanism 150 can be blown to the side faces of the sheet stack S that are parallel to the sheet feeding direction, while performing the separating operation for displacing the lift plate 31 between the sheet feeding position and the separating position. Consequently, as in the first embodiment, the sheet loosening efficiency can be enhanced and reduction in size of the entire sheet feeding device 130 can be achieved.

Note that in the first and second embodiments, when the same type of sheets P are accommodated in the plurality of sheet feeding units 130, it is desired that the sheet feeding position and the separating position be shifted between the plurality of sheet feeding units 130 accommodating the same type of sheets P, to control the sheet feeding operation alternately. In other words, when the lift plate 31 of one of the sheet feeding units 130 is positioned in the sheet feeding position, the lift plate 31 of another sheet feeding unit 130 is controlled to be positioned in the separating position.

In this manner, any of the lift plates 31 is always placed in the sheet feeding position, and therefore the sheet loosening mechanism with warm air that can loosen the sheets highly efficiently can be realized without reducing the number of prints per unit time. Particularly, the advantages of the constitution described can be appreciated when coat paper is used.

Third Embodiment

Next, a sheet feeding unit 1301 (sheet feeding device) according to a third embodiment is described. As described in the first embodiment, the position of the lift plate 31 is changed between the sheet feeding position and the separating position as the push-up member 32 is rotated about the drive shaft 36 (rotary axis) in the axial direction. The sheet feeding unit 1301 is characterized in performing, in accordance with the number of sheets carried on the lift plate 31, a control to change the amount of rotation of the push-up member 32 rotated about the drive shaft 36 in the axial direction during the separating operation.

Figure 20:
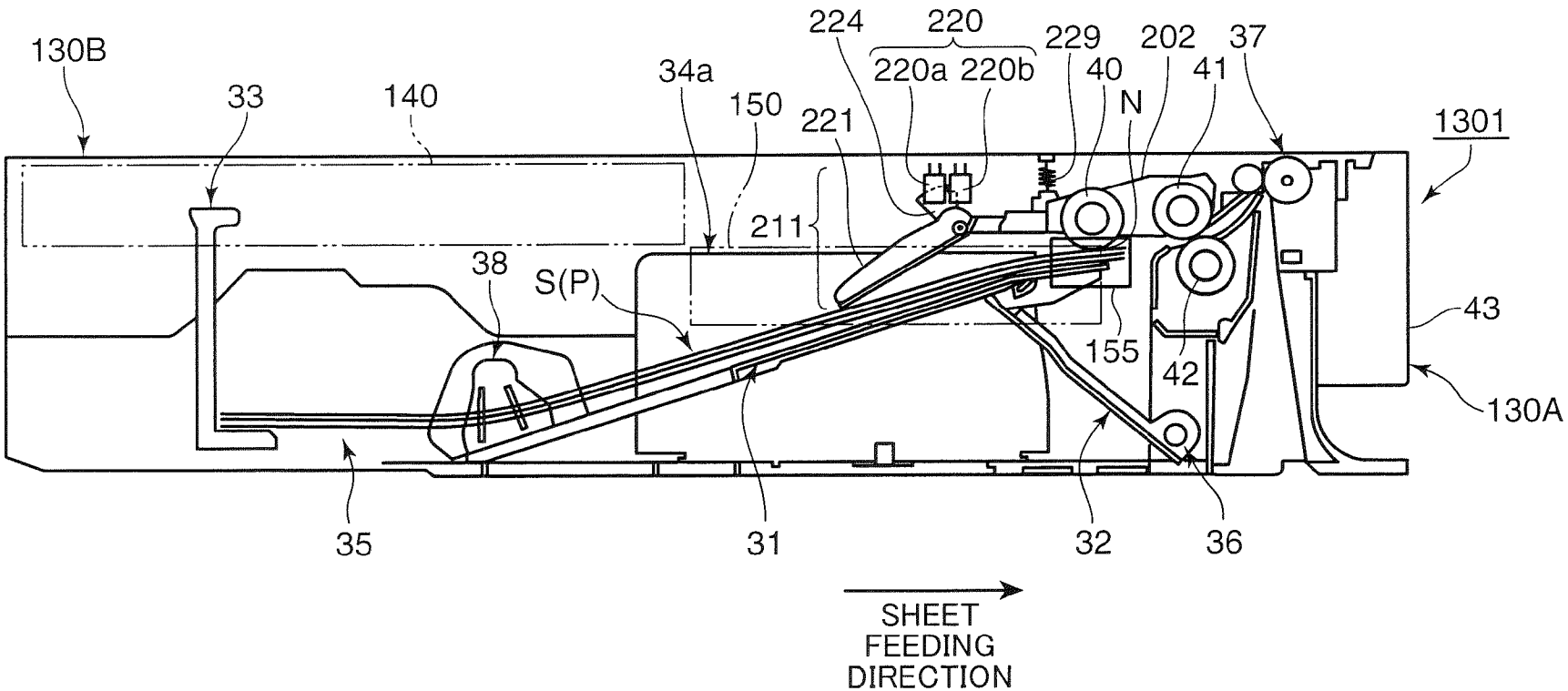
FIG. 20 is a sectional view showing the constitution of a sheet feeding device according to a third embodiment.

FIG. 20 is a sectional view showing the constitution of the sheet feeding unit 1301 according to the third embodiment. In FIG. 20, the same members as those shown in FIG. 3 described in the first embodiment are applied with the same reference symbols. The difference with the embodiments described above is that the present embodiment has the sheet remaining amount detection portion 211 for detecting the number of sheets carried on the lift plate 31. Hereinafter, description the same members as those of the above embodiments is omitted, and the sheet remaining amount detection portion 211 is described.

The sheet remaining amount detection portion 211 includes an actuator 221, and a detector 220 that detects a behavior of the actuator 221 and outputs the behavior in the form of an electric signal. The actuator 221 is attached to a front end of a supporting body 202 securing the pickup roller 40, via an elastic member 229.

Figure 21A:
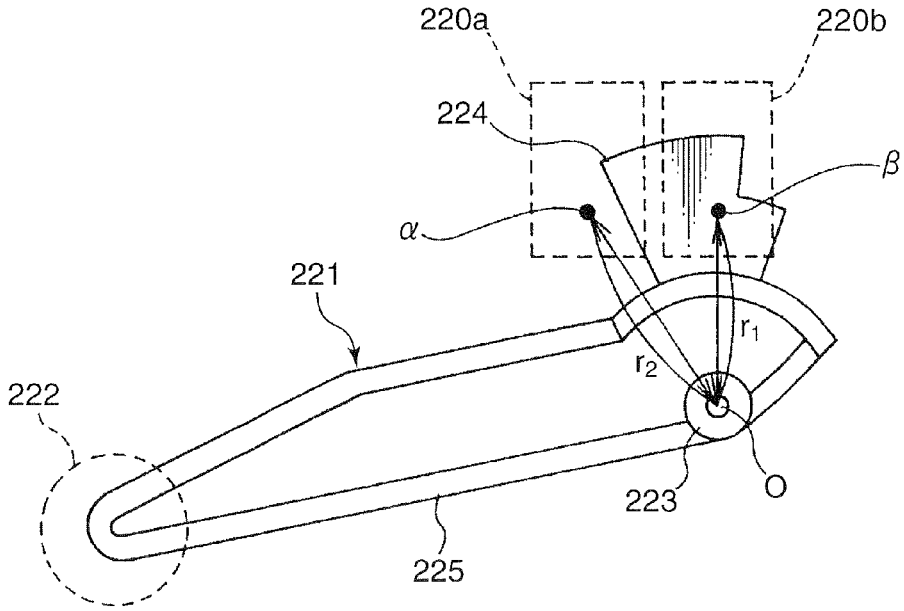
FIGS. 21A, 21B and 22 are illustrative views of an actuator constituting a sheet remaining amount detection portion.
Figure 21B:
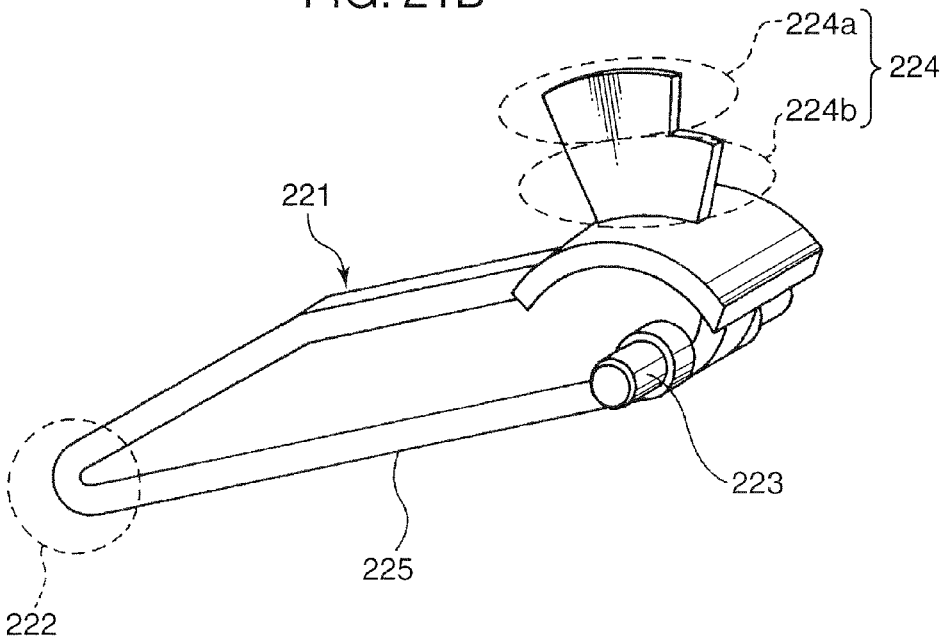
Figure 22:
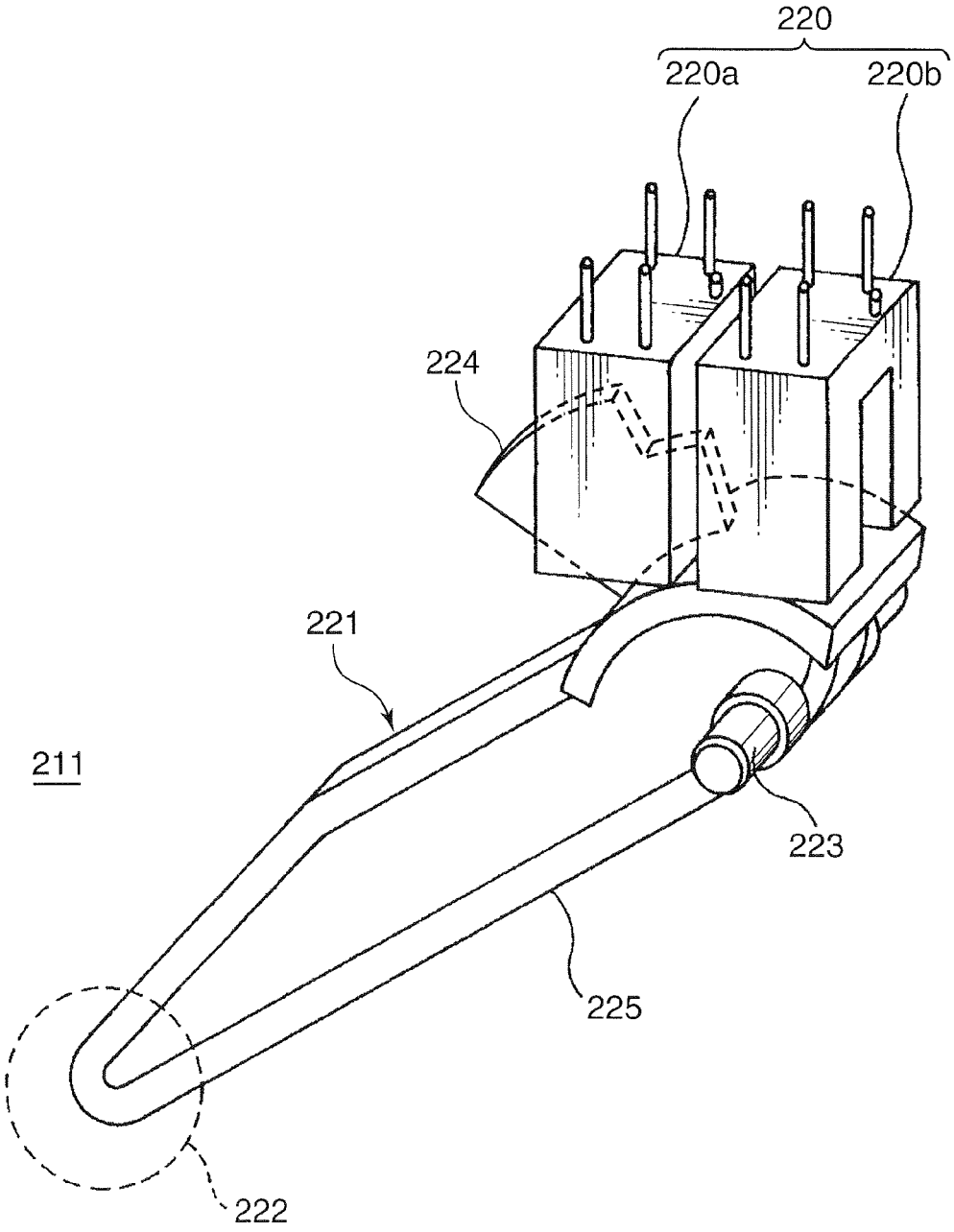

FIGS. 21A, 21B and 22 are illustrative views of the actuator 221. The actuator 221 includes a main body portion 225, a contact portion 222 formed on one end side of the main body portion 225 and contacting the upper face of the sheet stack S, a rotary axis 223 provided on the other end side of the main body portion 225 and rotatably supports the main body portion 225, and a shielding portion 224 formed at an end on the rotary axis 223 side of the main body portion 225. The detector 220, on the other hand, includes a pair of photo interrupters 220*a*, 220*b* of the same type.

FIG. 21A shows a side view of the actuator 221, and FIG. 21B shows a perspective view of the actuator 221. The shielding portion 224 of the actuator 221 is made of a plate-like member and includes a first part 224*a* crossing an optical axis $\alpha$ of the photo interrupter 220*a* and a second part 224*b* crossing an optical axis $\beta$ of the photo interrupter 220*b* and formed into a shape different from that of the first part 224*a*.

As shown in FIG. 21A, the actuator 221 is formed such that a distance r2 between a rotation center O of the rotary axis 223 of the actuator 221 and the optical axis $\alpha$ of the photo interrupter 220*a*, and a distance r1 between the rotation center O and the optical axis $\beta$ of the photo interrupter 220*b* satisfy the relationship of $r2>r1$.

The sheet remaining amount detection portion 211 detects ON/OFF signals generated by that the shielding portion 224 crosses the optical axis $\alpha$ of the photo interrupter 220*a* or the optical axis $\beta$ of the photo interrupter 220*b* in accordance with changes in the contact angle between the upper face of the sheet stack S and the contact portion 222. Consequently, the sheet remaining amount detection portion 211 can detect, in four stages, the sheet remaining amount by means of a combination of the ON/OFF signals of the two photo interrupters 220*a*, 220*b*.

Specifically, when expressing the combination of ON/OFF signals as ON/OFF states of the photo interrupter (PI) 220*a* and ON/OFF states of the photo interrupter (PI) 220*b*, the following combinations are obtained in the order of greater sheet remaining amount:

PI220*a*=ON, PI220*b*=OFF . . . the state shown in FIG. 21A

PI220*a*=OFF, PI220*b*=OFF

PI220*a*=OFF, PI220*b*=ON . . . the state shown in FIG. 22

PI220*a*=ON, PI220*b*=ON

In the constitution described above, the distance between each optical axis of a plurality of photo interrupters and the rotation center of the actuator may be changed, and therefore, the actuator 221 and the detector 220 should not be limited based on the shape of the shielding portion, the position of the rotary axis, the concrete shape or the like of the front end, or the layout of each portion. In addition, in the constitution described above, the sheet remaining amount detection portion 211 is constituted by the two photo interrupters 220*a*, 220*b*, but it may be constituted by three or more photo interrupters.

Figure 23:
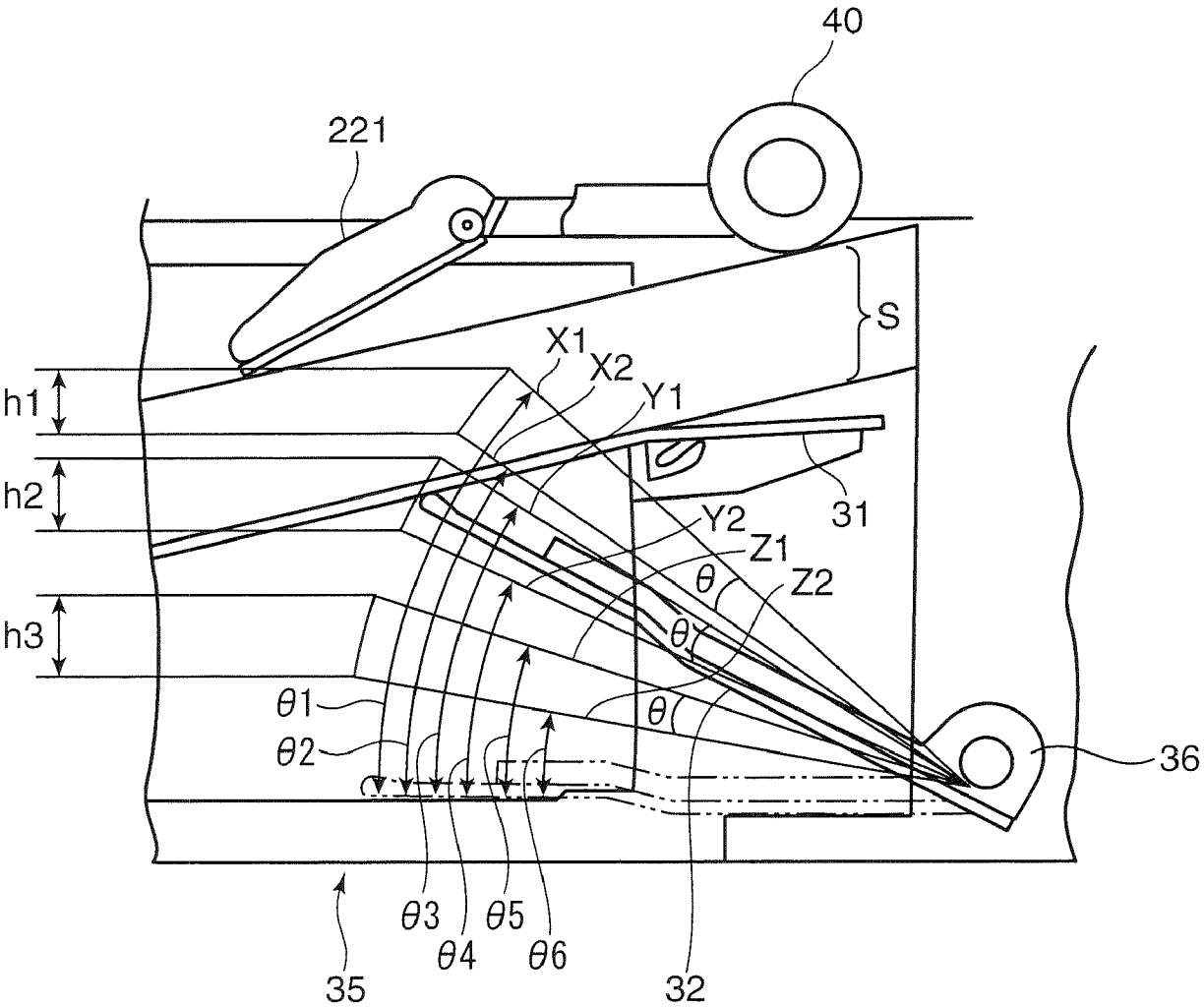
FIG. 23 is an illustrative view for illustrating an operation performed by the sheet feeding device according to the third embodiment.

Referring to FIG. 23, the following describes the relationship between the remaining amount of sheets of the sheet stack S carried on the lift plate 31 and the lowered amount, the relationship being obtained when lowering and driving the lift plate 31 using the elevator mechanism 30.

In order for the push-up member 32 to push up the lift plate 31 to the sheet feeding position, the lower the amount of remaining sheets of the sheet stack S carried on the lift plate 31, the higher the lift plate 31 needs to be pushed up. For example, it is assumed that the position of the push-up member 32 lifting up the lift plate 31 to the sheet feeding position is obtained as X1, Y1 and Z1 (X1, Y1 and Z1 in the order of lower amount of remaining sheets of the sheet stack S). Further, it is assumed that X2, Y2 and Z2 are obtained as the positions of the push-up member 32 lowered by rotating the drive shaft 36 of the elevator mechanism from each of X1, Y1 and Z1 by the same rotational angle θ in a lowering direction.

In the case described above, the amount at which the lift plate 31 (and the sheet stack S carried on the lift plate 31) is lowered is expressed as h1 in FIG. 14, by displacing the position of the push-up member 32 from X1 to X2. The h1 is expressed by the following equation when the length of the push-up member 32 (i.e., the radius of rotation) is expressed as r, and when the angles of the positions X1 and X2 to the drive shaft are θ1 and θ2 on the basis that the push-up member 32 is in a horizontal position:

$$h1=r\ (\sin\theta1-\sin\theta2)$$

Similarly, by displacing the push-up member 32 from Y1 to Y2, the amount at which the lift plate 31 is lowered is expressed as h2. The h2 is expressed by the following equation when the angles of the positions Y1 and Y2 to the drive shaft are θ3 and θ4 on the basis that the push-up member 32 is in the horizontal position:

$$h2=r\ (\sin\theta3-\sin\theta4)$$

Similarly, by displacing the push-up member 32 from Z1 to Z2, the amount at which the lift plate 31 is lowered is expressed as h3. The h3 is expressed by the following equation when the angles of the positions Z1 and Z2 to the drive shaft are θ5 and θ6 on the basis that the push-up member 32 is in the horizontal position:

$$h3=r\ (\sin\theta5-\sin\theta6)$$

According to the above description, the amount at which the lift plate 31 is lowered is expressed as h1<h2<h3. Specifically, when the drive shaft 36 of the elevator mechanism 30 is rotated from the sheet feeding position state by the same rotation angle θ in the lowering direction, the lower the amount of remaining sheets of the sheet stack S, the lower the amount at which the lift plate 31 is lowered.

Therefore, in the third embodiment, when lowering and driving the lift plate 31 from the sheet feeding position to the separating position, the lowering amount of the lift plate 31 is controlled such that the distance between the upper face of the sheet stack S in the separating position and the pickup roller 40 is not significantly changed by the amount of remaining sheets of the sheet stack S carried on the lift plate 31. In other words, the elevator mechanism 30 is controlled such that the amount of rotation of the drive shaft 36 is changed during the separating operation in accordance with the amount of remaining sheets of the sheet stack S that is detected by the sheet remaining amount detection portion 211. More specifically, the elevator mechanism 30 is controlled such that the lower the amount of remaining sheets of the sheet stack S, the greater the amount of rotation of the drive shaft 36.

Figure 24:
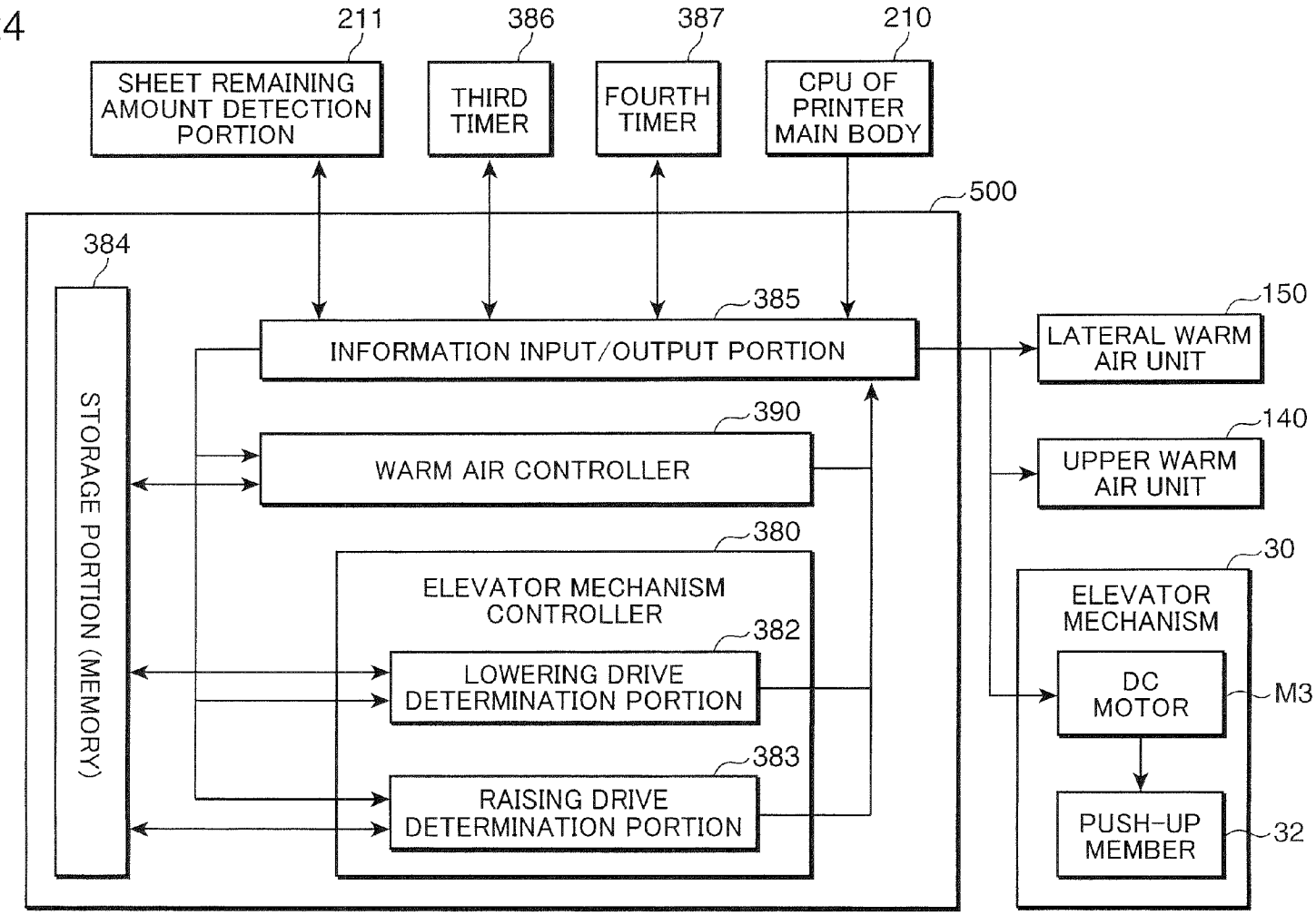
FIG. 24 is a functional block diagram of a controller controlling a warm air blowing operation in the sheet feeding device according to the third embodiment.
Figure 25:
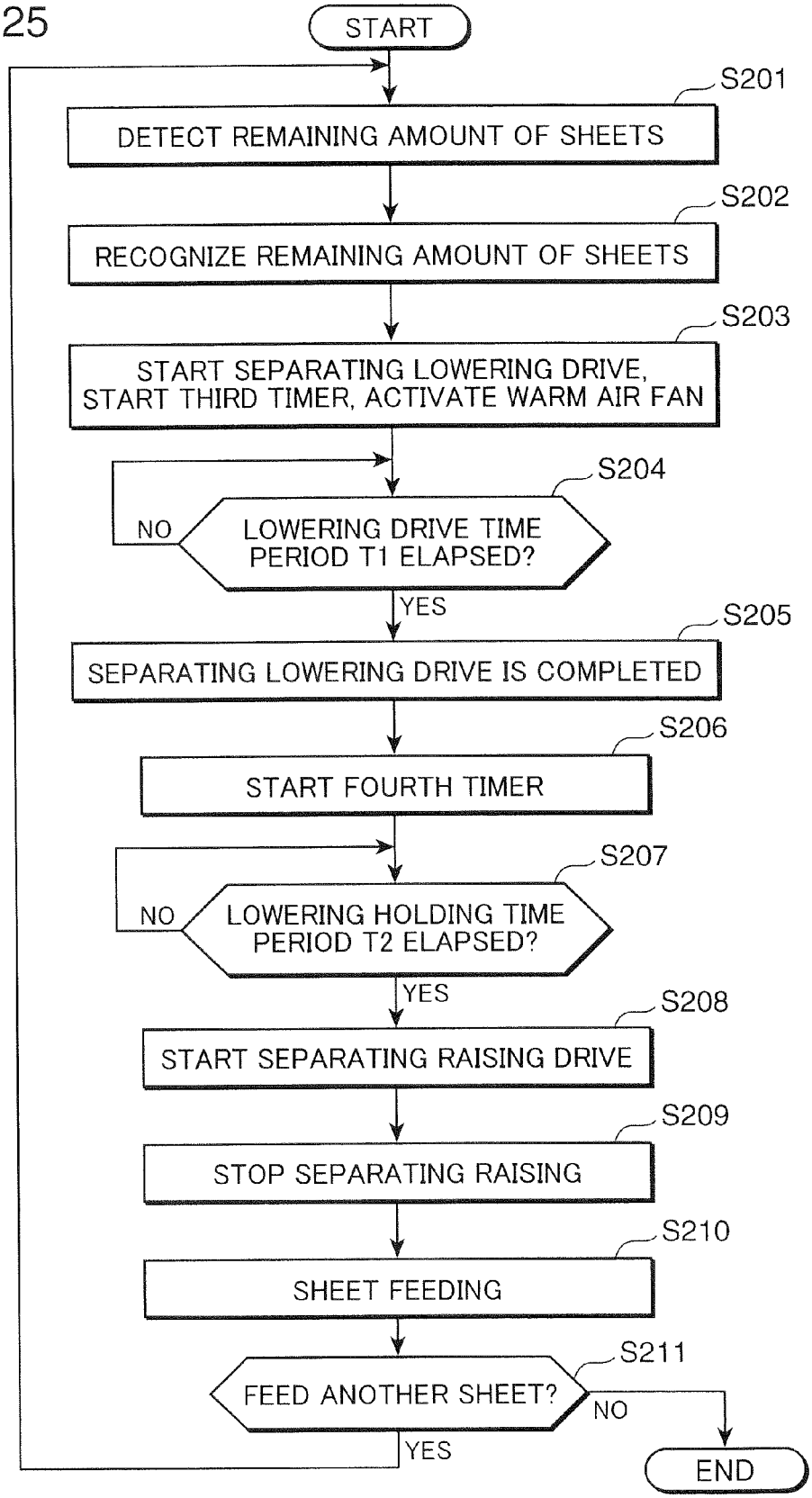
FIG. 25 is a flowchart showing a control operation performed by the controller shown in FIG. 24.

Next, the sheet loosening operation performed by the sheet feeding unit 1301 according to the third embodiment is described with reference to FIGS. 24 and 25. FIG. 24 is a functional block diagram of a controller 500 according to the third embodiment. FIG. 25 is a flowchart showing a control operation performed by the controller 500.

As in the first and second embodiments, the controller 500 of the sheet feeding unit 1301 according to the third embodiment controls elevation drive of the elevator mechanism 30 such that the lift plate 31 is displaced between the sheet feeding position and the separating position during the warm air blowing operation performed by the lateral warm air mechanism 150. Furthermore, the controller 500 controls the elevator mechanism 30 so as to change the amount of rotation of the drive shaft 36 in the separating operation, in accordance with the amount of sheets of the sheet stack S, which is detected by the sheet remaining amount detection portion 211.

The controller 500 includes an information input/output portion 385, a warm air controller 390, an elevator mechanism controller 380, and a storage portion 384. The elements existing around the controller 500 in FIG. 24 are the same as the elements described with reference to FIG. 13 or FIG. 15.

A position detection signal from the sheet remaining amount detection portion 211, the third time-up signal from the third timer (timer) 386, the fourth time-up signal from the fourth timer 387, and the cassette selection signal and warm air request signal from the CPU 210 of the printer main body 200 side are input to the information input/output portion 385.

The warm air controller 390 controls the drive of the lateral warm air mechanism 150 and the upper warm air mechanism 140 on the basis of the cassette selection signal and the warm air request signal. Based on these input signals, the warm air controller 390 outputs control signals for driving the lateral warm air mechanism 150 and the upper warm air mechanism 140 to a drive motor (not shown) of each unit through the information input/output portion 385.

The elevator mechanism controller 380, having a lowering drive determination portion 382 and an raising drive determination portion 383, controls an elevation drive operation performed by the elevator mechanism 30 on the basis of the third time-up signal from the third timer 386 and the fourth time-up signal from the fourth timer 387, to cause the elevator mechanism 30 to carry out the separating operation for displacing the lift plate 31 between the sheet feeding position and the separating position.

Based on the position detection signal and remaining amount detection signal from the sheet remaining amount detection portion 211, as well as the third time-up signal from the third timer 386, the lowering drive determination portion 382 outputs a control signal for lowering and driving the push-up member 32, to the DC motor M3 via the information input/output portion 385. Similarly, based on the fourth time-up signal from the fourth timer 387, the raising drive determination portion 383 outputs a control signal for raising and driving the push-up member 32, to the DC motor M3 via the information input/output portion 385.

The storage portion 384 stores therein a plurality of third time-up values (drive time periods in which the DC motor M3 for lowering and driving the push-up member 32 is driven) of the third timer 386, each of which corresponds to the lowering drive time period corresponding to the amount (remaining amount) of sheets of the sheet stack S that is detected by the sheet remaining amount detection portion 211.

As described above, the sheet remaining amount detection portion 211 is constituted to be able to detect the amount of remaining sheets of the sheet stack S, in four stages. Therefore, the storage portion 384 stores therein four third time-up values corresponding to the amount of sheets of the sheet stack S that is detected in four stages.

The storage portion 384 further stores therein a plurality of fourth time-up values of the fourth timer 387 corresponding to sheet feeding speed, and the size, material and mode of a selected sheet, and an operation program of each controller. In addition, the storage portion 384 is provided with a storage area for temporarily storing the determination results and other information.

Note that in this embodiment the DC motor M3 is employed as the drive motor of the push-up member 32, but a stepping motor (not shown) for forwardly and reversely rotating the drive shaft 36, for example, may be employed instead. In addition, in place of the DC motor M3 or stepping motor, a spring or other biasing means may be used to rotate the push-up member 32 about the rotary axis and to thereby displace the lift plate 31 between the sheet feeding position and the separating position.

When using the stepping motor, the number of lowering drive steps for each of the plurality of stepping motors (four in the constitution of this embodiment) that corresponds to the amount of sheets of the sheet stack S is stored in the storage portion 384. Based on the result of detection by the sheet remaining amount detection portion 211, the controller 500 reads, from the storage portion 384, the number of lowering drive steps of each stepping motor that corresponds to the amount of sheet-form recording media, and controls the lowering drive of the elevator mechanism 30 so as to rotate the stepping motor by the number of lowering drive steps.

Next, referring to FIGS. 24 and 25, the control operation performed by the controller 500 according to the third embodiment will be described. When the cassette selection signal is input from the CPU 210 of the printer main body 200 via the information input/output portion 385, the raising drive determination portion 383 of the elevator mechanism controller 380 outputs a control signal for raising and driving the push-up member 32, to the DC motor M3 via the information input/output portion 385, on the basis of the cassette signal. As a result, raising and driving of the push-up member 32 begins. Next, when it is determined based on the position detection signal of the sheet remaining amount detection portion 211 that the lift plate 31 is raised to the sheet feeding position, the raising drive determination portion 383 stops raising and driving of the push-up member 32.

In this state, the amount (remaining amount) of sheets of the sheet stack S carried on the lift plate 31 is detected by the sheet remaining amount detection portion 211 (S201).

Based on the remaining amount detection signal regarding the sheets P, which is detected by the sheet remaining amount detection portion 211, the controller 500 recognizes any one of the four stages to which the amount (remaining amount) of sheets P carried on the lift plate 31 belongs (S202).

The lowering drive determination portion 382 reads, from the storage portion 384, a lowering drive time period T1 corresponding to the remaining amount of sheets P recognized in S202, and starts a third timer 386 for timing the lowering drive time period T1. As a result, the push-up member 32 starts a separating and lowering drive operation. At the same time, the warm air controller 390 outputs the control signals for driving the lateral warm air mechanism 150 and the upper warm air mechanism 140, to the drive motor (not shown) of each unit via the information input/output portion 385 (S203).

Based on a third time-up signal from the third timer 386, the lowering drive determination portion 382 determines whether or not the lowering drive time period T1 has elapsed (S204). Specifically, the DC motor M3 is continuously driven until the lowering drive time period T1 elapses in S204, and thereby the separating and lowering drive operation on the push-up member 32 is continued. Then, when it is determined based on a third time-up signal from the third timer 386 that the lowering drive time period T1 has elapsed (YES in S204), the lowering drive determination portion 382 outputs a control signal for stopping the lowering drive of the push-up member 32, to the DC motor M3 via the information input/output portion 385. Consequently, the separating and lowering drive operation is completed (S205).

Once the separating and lowering drive operation of S205 is completed, the raising drive determination portion 383 starts a fourth timer 387 for timing a predetermined lowering and holding time period T2 (S206). Next, based on a fourth time-up signal from the fourth timer 387, the raising drive determination portion 383 determines whether or not the predetermined lowering and holding time period T2 has elapsed (S207). The fourth timer 387 continues to time until the lowering and holding time period T2 elapses, and the lift plate 31 is held at the separating position. When, on the other hand, it is determined based on the fourth time-up signal that the lowering and holding time period T2 has elapsed (YES in S207), the raising drive determination portion 383 outputs the control signal for raising and driving the push-up member 32, to the DC motor M3 via the information input/output portion 385. As a result, the DC motor M3 is activated and raising and driving of the push-up member 32 begins (S208).

Thereafter, when the sheet remaining amount detection portion 211 detects that the upper face of the sheet stack S carried on the lift plate 31 reaches the sheet feeding position, the raising drive determination portion 383 outputs the control signal for stopping raising and driving the push-up member 32, to the DC motor M3 via the information input/output portion 385, to thereby stop raising and driving of the push-up member 32 (S209). Then, feeding of the sheets P of the uppermost layer of the sheet stack S is started (S210). When feeding of the sheets P is started, it is determined whether or not to feed one more sheet P (S211). When another sheet P needs to be fed (YES in S211), the processing from the step S201 is repeated. On the other hand, when it is not necessary to feed another sheet (NO in S211), the processing is ended.

According to the constitution of the third embodiment, the elevator mechanism 30 is controlled such that the amount of rotation of the drive shaft 36 in the separating operation is changed in accordance with the amount of sheets P detected by the sheet remaining detection portion 211. Therefore, regardless of the amount of sheets P (sheet stack S) carried on the lift plate 31, the amount of sheets of the sheet stack S to be lowered in order to blow warm air efficiently and stably into the sheets can be ensured.

Note that the specific embodiments described above mainly include the inventions having the following constitutions.

The sheet feeding device according to one aspect of the present invention is a sheet feeding device for feeding a sheet, including: a sheet accommodating portion for accommodating a sheet stack constituted by a plurality of sheets; a sheet carrying plate for carrying the sheet stack, a sheet feeding direction upstream side end of which is supported within the sheet accommodating portion to be free to rotate; a pickup roller that contacts an upper face of the sheet stack and dispatches an uppermost sheet of the sheet stack; an elevator mechanism that displaces the sheet carrying plate between a sheet feeding position in which the upper face of the sheet stack contacts the pickup roller and a separating position in which the upper face of the sheet stack is separated from the pickup roller; a first warm air mechanism for blowing warm air toward a side face of the sheet stack accommodated in the sheet accommodating portion, the side face being parallel to the sheet feeding direction; and a controller for controlling the operation of the elevator mechanism, wherein the controller controls the operation of the elevator mechanism such that the sheet carrying plate is displaced between the sheet feeding position and the separating position during a warm air blowing operation performed by the first warm air mechanism.

According to this constitution, the controller controls the operation of blowing warm air from the first warm air mechanism toward the side face of the sheet stack that is parallel to the sheet feeding direction, while performing the separating operation of displacing the sheet carrying plate between the sheet feeding position and the separating position. Because the space between the sheets of the sheet stack can be increased by performing this separating operation, warm air in spot form can be blown easily toward a section within the sheet stack that is far away from the warm air blowing port. Hence, a small-sized sheet feeding device that has a higher sheet loosening efficiency can be provided.

In the constitution described above, it is desired that sheet feeding device further have a first timer for timing a time period from when the pickup roller starts dispatching the sheet, wherein the controller controls the operation of the elevator mechanism such that the sheet carrying plate is displaced between the sheet feeding position and the separating position when the first timer times a first predetermined time period.

According to this constitution, the first time is used for controlling the timing to start lowering the sheet carrying plate from the sheet feeding position to the separating position. Hence, the time can be set at appropriate lowering start timing in accordance with the sheet feeding conveyance speed of each sheet feeding device (the number of sheets that can be conveyed per minute), and the material or the like of the sheet.

In this case, it is desired that the sheet feeding device further include a conveyance roller pair provided on the sheet feeding direction downstream side of the pickup roller and sandwiching the sheet dispatched by the pickup roller to convey the sheet, wherein the first predetermined time period is set at a time period required for the sheet to reach the conveyance roller pair.

It is desired that the sheet feeding device further include a loosening roller pair provided between the pickup roller and the conveyance roller pair, wherein the first predetermined time period is set at a time period required for the sheet to pass between the loosening roller pair and reach the conveyance roller pair.

When continuously feeding the sheets, lowering of the sheet carrying plate needs to be started at the earliest timing at which the sheets are conveyed in a stable manner. However, when lowering of the sheet carrying plate is started before the sheet dispatched from the pickup roller is carried on the stable conveyance path, the sheets are shifted, causing a paper jam. On the other hand, when the sheet carrying plate is lowered too late, the sheet stack is pressed against the pickup roller for a long time, whereby a sheet loosening effect employing warm air that involves the separating operation cannot be obtained.

Specifically, when lowering of the sheet carrying plate is started as soon as the sheet dispatched from the pickup roller passes through the loosening roller pair provided on the conveyance direction downstream side of the pickup roller, for example, the sheet remains sandwiched by the loosening roller pair only because the sheet is released from the pickup roller, and therefore a stable sheet feeding state cannot be maintained. On the other hand, when the sheet passes between the loosening roller pair and reaches the conveyance roller pair on the downstream side of the loosening roller pair, the front end side of the sheet is held between the conveyance roller pair and the rear end side of the sheet is held between the loosening roller pair, although the sheet is separated from the pickup roller. Therefore, the sheets are prevented from being shifted.

In this manner, the first predetermined time period set by the first timer is set at a time period required for the sheet to reach the conveyance roller pair from the pickup roller. As a result, lowering of the sheet carrying plate can be started at the earliest timing at which a stable conveyance of the sheet can be ensured. Consequently, by blowing warm air by means of the separating operation, the sheet stack can be loosened more efficiently prior to sheet feeding.

The constitution described above further includes the conveyance roller pair provided on the sheet feeding direction downstream side of the pickup roller and sandwiching the sheet dispatched by the pickup roller to convey the sheet, and a front end detection portion for detecting a state in which a sheet feeding direction front end portion of the sheet dispatched by the pickup roller passes between the conveyance roller pair, wherein the controller controls the operation of the elevator mechanism such that lowering of the sheet carrying plate from the sheet feeding position and the separating position is started when the front end detection portion detects the state.

According to this constitution as well, the sheet loosening effect employing warm air can be realized while maintaining a desired sheet feeding conveyance speed.

In the constitution described above, it is desired that sheet feeding device further have a second timer for timing a time period from when the lowering of the sheet carrying plate is completed, wherein the controller controls the operation of the elevator mechanism such that raising of the sheet carrying plate from the separating position to the sheet feeding position is started when the second timer times a second predetermined time period.

According to this constitution, a recovery operation for recovering the sheet carrying plate from the separating position to the sheet feeding position can be securely controlled based on the result of timing performed by the second timer.

In the constitution described above, it is desired that the sheet feeding device further include a conveyance roller pair provided on the sheet feeding direction downstream side of the pickup roller and sandwiching the sheet dispatched by the pickup roller to convey the sheet, and a rear end detection portion for detecting a state in which a sheet feeding direction rear end portion of the sheet dispatched by the pickup roller passes between the conveyance roller pair, wherein the controller controls the operation of the elevator mechanism such that raising of the sheet carrying plate from the separating position to the sheet feeding position is started when the rear end detection portion detects the state.

According to this constitution, because the sheet carrying plate is raised from the separating position to the sheet feeding position when the sheet feeding direction rear end portion of the sheet passes between the conveyance roller pair, the sheet feeding intervals can be reduced.

According to the constitution described above, it is desired that the first predetermined time period and the second predetermined time period be set in accordance with the conveyance speed for conveying the sheet. According to this constitution, the timing of raising and lowering the sheet carrying plate can be optimized in accordance with the conveyance speed.

In the constitution described above, it is desired that the sheet feeding device further include a sheet remaining amount detection portion for detecting the amount of sheets carried on the sheet carrying plate, wherein the elevator mechanism includes a rotary axis and a push-up member, one end of which is supported rotatably by the rotary axis and the other end which comes into contact with a bottom face of the sheet carrying plate to push up the sheet carrying plate, the push-up member being rotated about the rotary axis in an axial direction, thereby displacing the sheet carrying plate between the sheet feeding position and the separating position, and the controller controls the operation of the elevator mechanism such that the amount of rotation of the rotary axis of the push-up member in the axial direction in the separating operation is changed in accordance with the amount of sheets that is detected by the sheet remaining amount detection portion.

According to this constitution, the amount of rotation of the rotary axis of the push-up member in the axial direction in the separating operation is changed in accordance with the amount of sheets carried on the sheet carrying plate. Therefore, regardless of the amount of sheets carried on the sheet carrying plate, the degree of lowering the sheet carrying plate that is required in order to blow warm air efficiently and stably into the sheets can be ensured.

In this case, the rotary axis is a drive axis, the elevator mechanism displaces the sheet carrying plate between the sheet feeding position and the separating position by driving the drive axis to rotate the push-up member, and the controller controls the operation of the elevator mechanism such that the amount of rotation of the drive axis in the separating operation is changed in accordance with the amount of sheets that is detected by the sheet remaining amount detection portion.

According to this constitution, the degree of lowering the sheet carrying plate can be adjusted by controlling the amount of rotating the drive axis itself functioning as the rotary axis.

In this case, the sheet feeding device further includes a storage portion for storing a lowering drive time period of the elevator mechanism corresponding to the amount of the sheets, and a third timer for timing a time period from when lowering drive of the sheet carrying plate is started, wherein the controller reads, from the storage portion, the lowering drive time period corresponding to the amount of sheets on the basis of a result of detection performed by the sheet remaining amount detection portion, and controls a lowering drive operation performed by the elevator mechanism, such that the drive axis is rotated until the lowering drive time period corresponding to the amount of sheets is timed by the third timer.

According to this constitution, lowering of the sheet carrying plate from the sheet feeding position to the separating position can be controlled securely on the basis of the result of timing by the third timer.

In addition, it is desired that the elevator mechanism include a stepping motor for forwardly and reversely rotating the drive axis, and a storage portion for storing a number of lowering drive steps of the stepping motor that corresponds to the amount of sheets, wherein the controller reads, from the storage portion, the number of lowering drive steps of the stepping motor that corresponds to the amount of sheets, and controls the lowering drive operation performed by the elevator mechanism, such that the stepping motor is rotated by the number of lowering drive steps corresponding to the amount of sheets.

According to this constitution, the raising and lowering control can be performed easily on the sheet carrying plate, by controlling the number of steps applied to the stepping motor.

It is desired that the sheet feeding device described above further include a second warm air mechanism for blowing warm air toward the upper face of the sheet stack accommodated in the sheet accommodating portion. According to this constitution, because warm air is blown toward the sheet stack in both a lateral direction and an upper direction, the sheets can be separated even more favorably.

The image forming apparatus according to another aspect of the present invention comprises: a sheet feeding device for feeding a sheet; and an apparatus main body including an image formation portion for forming an image on the sheet fed from the sheet feeding device, wherein the sheet feeding device includes: a sheet accommodating portion for accommodating a sheet stack constituted by a plurality of sheets; a sheet carrying plate for carrying the sheet stack, a sheet feeding direction upstream side end of which is supported within the sheet accommodating portion to be free to rotate; a pickup roller that contacts an upper face of the sheet stack and dispatches an uppermost sheet of the sheet stack; an elevator mechanism that displaces the sheet carrying plate between a sheet feeding position in which the upper face of the sheet stack contacts the pickup roller and a separating position in which the upper face of the sheet stack is separated from the pickup roller; a first warm air mechanism for blowing warm air toward a side face of the sheet stack accommodated in the sheet accommodating portion, the side face being parallel to the sheet feeding direction; and a controller for controlling the operation of the elevator mechanism, wherein the controller controls the operation of the elevator mechanism such that the sheet carrying plate is displaced between the sheet feeding position and the separating position during a warm air blowing operation performed by the first warm air mechanism.

According to the constitution described above, a lateral warm air mechanism that has a higher sheet loosening efficiency than a conventional large lateral warm air assistance can be realized as the sheet loosening mechanism employing warm air, thereby achieving reduction in size of the sheet feeding device. Therefore, the size of the entire image forming apparatus that has the sheet feeding device having the sheet loosening mechanism employing warm air can be reduced.

In the constitution described above, it is desired that the sheet feeding device further include a first timer for timing a time period from when the pickup roller starts dispatching the sheet, wherein the controller controls the operation of the elevator mechanism such that lowering of the sheet carrying plate from the sheet feeding position to the separating position is started when the first timer times a first predetermined time period, the first predetermined time period being changed in accordance with at least either an image formation speed of the apparatus main body or a conveyance speed for conveying the sheet.

In the constitution described above, it is desired that the sheet feeding device further have a second timer for timing a time period from when the lowering of the sheet carrying plate is completed, wherein the controller controls the operation of the elevator mechanism such that raising of the sheet carrying plate from the separating position to the sheet feeding position is started when the second timer starts timing a second predetermined time period, the second predetermined time period being changed in accordance with at least either the image formation speed of the apparatus main body or the conveyance speed for conveying the sheet.

According to these constitutions, the lowering and raising operation on the sheet carrying plate can be carried out at the timing in accordance with the image formation speed or the conveyance speed for conveying the sheet, whereby the sheet feeding intervals can be reduced as quickly as possible.

As described above, the present invention can provide a sheet feeding device that has a sheet loosening mechanism employing warm air assistance and can be set even in a small space by improving the sheet loosening efficiency employing warm air, as well as an image forming apparatus having the sheet feeding device.

This application is based on Japanese patent application serial Nos. 2008-200815 and 2008-200823, filed in Japan Patent Office on Aug. 4, 2008 respectively, the contents of which is hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A sheet feeding device for feeding a sheet, comprising:

a sheet accommodating portion for accommodating a sheet stack constituted by a plurality of sheets;

a sheet carrying plate for carrying the sheet stack, a sheet feeding direction upstream side end of which is supported within the sheet accommodating portion to be free to rotate;

a pickup roller that contacts an upper face of the sheet stack and dispatches an uppermost sheet of the sheet stack;

an elevator mechanism that displaces the sheet carrying plate between a sheet feeding position in which the upper face of the sheet stack contacts the pickup roller and a separating position in which the upper face of the sheet stack is separated from the pickup roller;

a first heated air mechanism for blowing heated air toward a side face of the sheet stack accommodated in the sheet accommodating portion, the side face being parallel to the sheet feeding direction;

a controller for controlling the operation of the elevator mechanism, wherein the controller controls the operation of the elevator mechanism such that the sheet carrying plate is displaced between the sheet feeding position and the separating position during a heated air blowing operation performed by the first heated air mechanism;

a conveyance roller pair provided on a sheet feeding direction downstream side of the pickup roller and sandwiching the sheet dispatched by the pickup roller to convey the sheet; and a rear end detection portion for detecting a state in which a sheet feeding direction rear end portion of the sheet dispatched by the pickup roller passes between the conveyance roller pair, wherein the controller controls the operation of the elevator mechanism such that raising of the sheet carrying plate from the separating position to the sheet feeding position is started when the rear end detection portion detects the state.

2. The sheet feeding device according to claim 1, further comprising:

a first timer for timing a time period from when the pickup roller starts dispatching the sheet, wherein the controller controls the operation of the elevator mechanism such that lowering of the sheet carrying plate from the sheet feeding position to the separating position is started when the first timer times a first predetermined time period.

3. The sheet feeding device according to claim 2, further comprising:

a conveyance roller pair provided on a sheet feeding direction downstream side of the pickup roller and sandwiching the sheet dispatched by the pickup roller to convey the sheet, wherein the first predetermined time period is set at a time period required for the sheet to reach the conveyance roller pair after the pickup roller starts dispatching the sheet.

4. The sheet feeding device according to claim 3, further comprising:

a loosening roller pair provided between the pickup roller and the conveyance roller pair, wherein the first predetermined time period is set at a time period required for the sheet to pass between the loosening roller pair and reach the conveyance roller pair after the pickup roller starts dispatching the sheet.

5. The sheet feeding device according to claim 2, wherein the first predetermined time period is set in accordance with a conveyance speed for conveying the sheet.

6. The sheet feeding device according to claim 1, further comprising:

a second timer for timing a time period from when lowering of the sheet carrying plate to the separating position is completed, wherein the controller controls the operation of the elevator mechanism such that raising of the sheet carrying plate from the separating position to the sheet feeding position is started when the second timer times a second predetermined time period.

7. The sheet feeding device according to claim 6, wherein the second predetermined time period is set in accordance with a conveyance speed for conveying the sheet.

8. The sheet feeding device according to claim 1, further comprising:

a sheet remaining amount detection portion for detecting the amount of sheets carried on the sheet carrying plate, wherein the elevator mechanism includes a rotary axis and a push-up member, one end of which is supported rotatably by the rotary axis and the other end of which comes into contact with a bottom face of the sheet carrying plate to push up the sheet carrying plate, the push-up member being rotated about the rotary axis in an axial direction, thereby displacing the sheet carrying plate between the sheet feeding position and the separating position, and wherein the controller controls the operation of the elevator mechanism such that the amount of rotation of the rotary axis of the push-up member in the axial direction in the separating operation is changed in accordance with the amount of sheets that is detected by the sheet remaining amount detection portion.

9. The sheet feeding device according to claim 8, wherein the rotary axis is a drive axis, the elevator mechanism displaces the sheet carrying plate between the sheet feeding position and the separating position by driving the drive axis to rotate the push-up member, and the controller controls the operation of the elevator mechanism such that the amount of rotation of the drive axis in the separating operation is changed in accordance with the amount of sheets that is detected by the sheet remaining amount detection portion.

10. The sheet feeding device according to claim 9, further comprising:

a storage portion for storing a lowering drive time period of the elevator mechanism corresponding to the amount of sheets; and a third timer for timing a time period from when lowering drive of the sheet carrying plate is started, wherein the controller reads, from the storage portion, the lowering drive time period corresponding to the amount of sheets on the basis of a result of detection performed by the sheet remaining amount detection portion, and controls a lowering drive operation performed by the elevator mechanism, such that the drive axis is rotated until the lowering drive time period corresponding to the amount of sheets is timed by the third timer.

11. The sheet feeding device according to claim 9, wherein the elevator mechanism includes a stepping motor for forwardly and reversely rotating the drive axis, the sheet feeding device further comprising:

a storage portion for storing a number of lowering drive steps of the stepping motor that corresponds to the amount of sheets, and wherein the controller reads, from the storage portion, the number of lowering drive steps of the stepping motor that corresponds to the amount of sheets, on the basis of a result of detection performed by the sheet remaining amount detection portion, and controls a lowering drive operation performed by the elevator mechanism, such that the stepping motor is rotated by the number of lowering drive steps corresponding to the amount of sheets.

12. The sheet feeding device according to claim 1, further comprising a second heated air mechanism for blowing heated air toward the upper face of the sheet stack accommodated in the sheet accommodating portion.

13. An image forming apparatus, comprising:

a sheet feeding device for feeding a sheet; and an apparatus main body including an image formation portion for forming an image on the sheet fed from the sheet feeding device, wherein the sheet feeding device includes:

a sheet accommodating portion for accommodating a sheet stack constituted by a plurality of sheets;

a sheet carrying plate for carrying the sheet stack, a sheet feeding direction upstream side end of which is supported within the sheet accommodating portion to be free to rotate;

a pickup roller that contacts an upper face of the sheet stack and dispatches an uppermost sheet of the sheet stack;

an elevator mechanism that displaces the sheet carrying plate between a sheet feeding position in which the upper face of the sheet stack contacts the pickup roller and a separating position in which the upper face of the sheet stack is separated from the pickup roller;

a first heated air mechanism for blowing heated air toward a side face of the sheet stack accommodated in the sheet accommodating portion, the side face being parallel to the sheet feeding direction;

a controller for controlling the operation of the elevator mechanism, and wherein the controller controls the operation of the elevator mechanism such that the sheet carrying plate is displaced between the sheet feeding position and the separating position during a heated air blowing operation performed by the first heated air mechanism;

a conveyance roller pair provided on a sheet feeding direction downstream side of the pickup roller and sandwiching the sheet dispatched by the pickup roller to convey the sheet; and a rear end detection portion for detecting a state in which a sheet feeding direction rear end portion of the sheet dispatched by the pickup roller passes between the conveyance roller pair, wherein the controller controls the operation of the elevator mechanism such that raising of the sheet carrying plate from the separating position to the sheet feeding position is started when the rear end detection portion detects the state.

14. The image forming apparatus according to claim 13, further comprising:

a first timer for timing a time period from when the pickup roller starts dispatching the sheet, wherein the controller controls the operation of the elevator mechanism such that lowering of the sheet carrying plate from the sheet feeding position to the separating position is started when the first timer times a first predetermined time period, the first predetermined time period being changed in accordance with at least either an image formation speed of the apparatus main body or a conveyance speed for conveying the sheet.

15. The image forming apparatus according to claim 13, further comprising:

a second timer for timing a time period from when lowering of the sheet carrying plate to the separating position is completed, wherein the controller controls the operation of the elevator mechanism such that raising of the sheet carrying plate from the separating position to the sheet feeding position is started when the second timer times a second predetermined time period, the second predetermined time period being changed in accordance with at least either an image formation speed of the apparatus main body or a conveyance speed for conveying the sheet.

* * * * *